US006563526B1

(12) United States Patent
Sekiya et al.

(10) Patent No.: US 6,563,526 B1
(45) Date of Patent: May 13, 2003

(54) IMAGE FORMATION APPARATUS

(75) Inventors: Toshiyuki Sekiya, Mishima (JP); Mitsuo Shiraishi, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/488,933

(22) Filed: Jan. 21, 2000

(30) Foreign Application Priority Data

Jan. 22, 1999 (JP) ..... 11-014872
Jan. 22, 1999 (JP) ..... 11-014873

(51) Int. Cl.[7] ..... B41J 2/47; B41J 2/45
(52) U.S. Cl. ..... 347/237; 347/238
(58) Field of Search ..... 347/237, 240, 347/247, 251, 129, 242, 238; 358/456, 458, 482, 298; 382/162, 173, 137

(56) References Cited

U.S. PATENT DOCUMENTS 5,357,351 A * 10/1994 Nakajima et al. ..... 358/482
5,517,318 A * 5/1996 Suzuki ..... 358/298
5,717,451 A * 2/1998 Katano et al. ..... 347/242
5,812,176 A * 9/1998 Kawabe et al. ..... 347/240
5,920,646 A * 7/1999 Kamon ..... 382/173
6,014,453 A * 1/2000 Sonoda et al. ..... 382/137
6,025,858 A * 2/2000 Tanioka et al. ..... 347/129
2001/0002139 A1 * 5/2001 Hiraoka ..... 347/238

FOREIGN PATENT DOCUMENTS

| | | |
|---|---|---|
| JP | 1-238962 | 9/1989 |
| JP | 2-208067 | 8/1990 |
| JP | 2-212170 | 8/1990 |
| JP | 3-20457 | 1/1991 |
| JP | 3-194978 | 8/1991 |
| JP | 4-5872 | 1/1992 |
| JP | 4-23367 | 1/1992 |
| JP | 4-296579 | 10/1992 |
| JP | 5-84971 | 4/1993 |

* cited by examiner

*Primary Examiner*—Hai Pham
(74) *Attorney, Agent, or Firm*—Fitzpatrick, Cella, Harper & Scinto

(57) ABSTRACT

An image formation apparatus which records an image on a recording medium has a recording element array head on which plural recording chips are disposed, and in the recording chip plural recording elements are arrayed. A main scan unit is for scanning the recording elements, and a sub-scan unit, for effecting relative motion between the recording medium and the recording chips in a sub-scanning direction. The main scan unit scans the recording elements n (n≧2) times on the basis of image data corresponding to one scan. The direction along which the recording elements are disposed, is deviated from the direction perpendicular to the sub-scanning direction, by a predetermined angle.

17 Claims, 17 Drawing Sheets

IMAGE FORMATION APPARATUS

BACKGROUND OF THE INVENTION

1. Field of the Invention

The present invention relates to an image formation apparatus which performs image formation by using a light emission element array such as an LED array.

2. Related Background Art

Conventionally, a self-scanning type LED (hereinafter called "SLED") array was introduced by Japanese Patent Applications (Laid-Open) Nos. 1-238962, 2-208067, 2-212170, 3-20457, 3-194978, 4-5872, 4-23367, 4-296579, and 5-84971, Japan Hard Copy '91 "Light Emission Element Array for Optical Printer in Which Driving Circuits are Integrated", *Proceedings of the* 1990 *IEICE* (*The Institute of Electronics, Information and Communication Engineers*) *Spring Conference* (Mar. 5, 1990), "Self-Scanning Type Light Emission Element (SLED) Using PNPN Thyristor Structure", and the like. Namely, the SLED has been remarked recently as a light emission element for used in recording.

Further, in such an image formation apparatus which is applied as a recording head disposed like the above LED array, if gradation is given to a written pixel, it is necessary to independently modulate a light emission current (i.e., a driving current) of each light emission element on the basis of multivalue image data, or it is necessary to independently modulate the length of a period L or a duty ratio of a signal ΦI on the basis of the multivalue image data. To perform such modulation, it is necessary to provide light emission current modulation means or light emission duty modulation means the number of which corresponds to the number of the light emission elements which simultaneously emit light on one head. Therefore, if such means is provided, the driving circuit becomes complicated and large in size.

Further, in the above-mentioned SLED, one light emission enable signal is input to one LED array chip. Therefore, it is necessary to provide plural modulation means the number of which corresponds to the number of LED array chips to be installed.

Further, in such an SLED head as above, a scan is independently performed by light emission of each LED array chip. Thus, according as a photosensitive drum is rotated in a sub-scan direction, a writing line on the photosensitive drum by the LED array head becomes inclined for each LED array chip, whereby one scan line (main-scan line) becomes like sawteeth.

This problem will be explained with reference to FIGS. 21 and 22.

FIG. 21 is an explanatory view which schematically shows a photosensitive body and an optical writing unit of an electrophotographic-system image formation apparatus which uses the LED array head as an optical writing means.

A cylindrical photosensitive drum 342 rotates at predetermined constant speed (i.e., a rotating speed Vd) in the direction indicated by the arrow when an image is formed. Numeral 210 denotes an LED array head which is disposed opposite the photosensitive drum 342 and on which plural LED array chips 211 are disposed. The direction along which the LED array chips 211 are disposed is substantially the axial direction of the photosensitive drum 342. Plural (i.e., 128 dots in this case) light emission pixels are aligned parallel to the chips along the longitudinal direction of the chip. The LED array chips 211 are aligned and disposed on a base substrate (not shown), and necessary driving signals are supplied to the chips 211 through not-shown bonding wires. In this explanation, the plural (i.e., 12 for simplification) LED array chips 211 are aligned on the base substrate.

Each LED array chip 211 scans the light emission points in the direction indicated by the arrow. Namely, the light emission pixels are sequentially shifted. Thus, according to the light emission of the LED array chips 211, optical writing (i.e., exposure) is performed on the photosensitive face of the opposite photosensitive drum 342. Such a main scan is repeated according to the rotation of the drum 342, whereby a sub-scan is performed.

FIG. 22 is an explanatory view which shows an example of the optical writing line formed on the photosensitive drum 342, together with the LED array chips 211.

The rotating speed of the photosensitive drum is assumed to be Vd, a repetition period in the sub-scan is assumed to be Ts, and resolution (light emission pixel pitch) in the main scan is assumed to be Pm. Generally, the repetition period in the sub-scan is set according to the following relation, and the resolution (i.e., the repetition period) in the sub-scan is suited to the resolution of the main scan:

$$Pm=Vd\times Ts$$

However, actually the scan line by the respective chips becomes a sawtooth-like line as shown in FIG. 22 including a nonconformity (or gap) represented by Vd×Ts (=Pm) in the sub-scan direction. This nonconformity (or gap) corresponds to one pixel pitch of the main-scan light emission pixel. If there are such sawteeth in the line, for example, when guidelines and characters in the main scan direction are printed, an unnatural nonconformity or gap occasionally appears on the periphery. Further, if a screen-processed gray image is written, a luminous beat occasionally appears in the screen image frequency at the nonconformity or gap portion.

Of course, the above problem due to the sawtoothed nonconformity is not specific to image formation apparatus using the SLED head. Namely, the same problem occurs in the LED array head structured to independently move and scan the light emission point in each of the plural divided area of the head and to perform optical writing.

SUMMARY OF THE INVENTION

An object of the present invention is to solve the above-mentioned conventional problems.

In order to achieve the above object, the present invention provides an image formation apparatus which records an image on a recording medium, comprising a recording element array head on which plural recording chips are disposed, in the recording chip plural recording elements being arrayed, main scan means, and sub-scan means. The main scan means scans the recording elements n ($n \geqq 2$) times on the basis of image data corresponding to one scan, and the direction along which the recording elements are disposed is deviated from the direction perpendicular to the sub-scan direction, by a predetermined angle.

Other objects and features of the present invention will become apparent from the following detailed description and the attached drawings.

DETAILED DESCRIPTION OF PREFERRED EMBODIMENTS

Initially, common parts in the later-described embodiments of the present invention will be explained.

Figure 15:
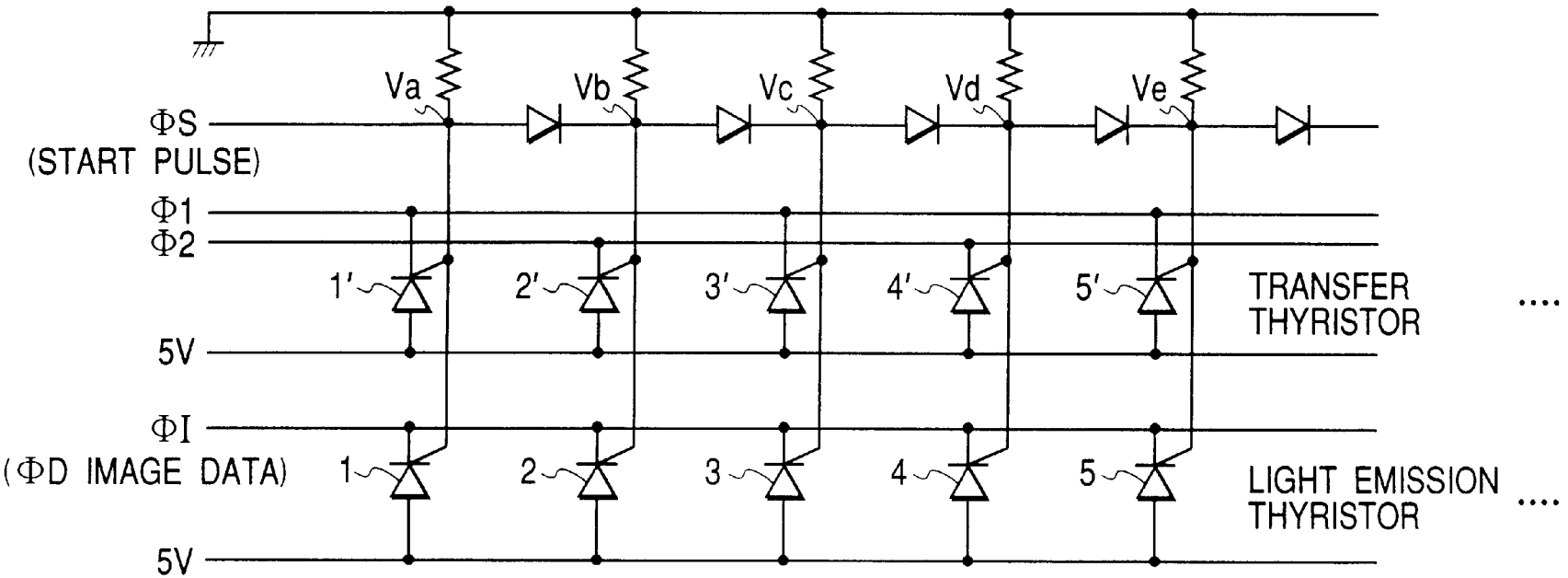
FIG. 15 is a circuit diagram showing an example of the basic structure of a self-scanning type light emission element (SLED) array.

FIG. 15 shows a self-scanning type light emission element (SLED) chip which is an example of a recording element array. The operation of the SLED chip will be explained hereinafter.

As shown in FIG. 15, the SLED chip includes transfer thyristors 1' to 5' which are cascade-connected and light emission thyristors 1 to 5 which are also cascade-connected. A gate signal is common to the respective thyristors. The gates of the first thyristors 1 and 1' are connected to the signal input part of a signal (start pulse) ΦS, the gates of the second thyristors 2 and 2' are connected to the cathode of the diode connected to the terminal of the signal ΦS, and the gates of the third thyristors 3 and 3' are connected to the cathode of the next diode.

FIGS. 16A to 16F are timing charts which show control signals to control the SLED and the turning on/off of the thyristor. Further, FIGS. 16A to 16F show an example in a case where all the elements are turned on. The data transfer and light emission will be explained with reference to FIGS. 16A to 16F.

The transfer is started by changing the signal ΦS (FIG. 16A) from 0V to 5V. If the signal ΦS comes to have 5V, a voltage Va=5V, a voltage Vb=3.7V (a forward-direction voltage drop of the diode is assumed to be 1.3V), a voltage Vc=2.4V, a voltage Vd=1.1V, and a voltage Ve and following voltages are 0V. The gate voltage of the transfer thyristor 1' is changed from 0V to 3.7V, the gate voltage of the transfer thyristor 2' is changed from 0V to 3.7V, and the gate voltages are changed in the similar manner.

In this state, if a signal ΦI (FIG. 16B) is changed from 5V to 0V, the transfer thyristor 1' has the anode potential 5V, the cathode potential 0V and the gate potential 3.7V, whereby the thyristor is turned on. If the transfer thyristor 1' is turned on, the thyristor 1' is on even if the signal ΦS is changed to 0V in this state, and the voltage Va≈5V is maintained. This is because the signal ΦS is applied through a resistor (not shown), and the potential between the anode and gate of the thyristor has the same value if the thyristor is on.

For this reason, even if the signal ΦS is changed to 0V, the on condition of the first thyristor is maintained, and a shift operation of the first thyristor ends. In this state, a signal ΦI (FIG. 16D) for the light emission thyristor is changed from 5V to 0V, the same condition as that the transfer thyristor is on is set. Thus, the light emission thyristor 1 is on, and the first LED is lit. Then, if the signal ΦI is returned to 5V, the potential difference between the anode and cathode of the light emission thyristor becomes zero. Thus, since the minimum holding current of the thyristor does not flow, the light emission thyristor 1 turns off.

Next, the on condition transfer from the thyristor 1' to the thyristor 2' will be explained.

Even if the light emission thyristor 1 is off, the signal ΦI maintains 0V. Thus, the gate voltage of the transfer thyristor 1' is Va≈5V with the transfer thyristor 1' on, and the voltage Vb=3.7V. In this state, if a signal Φ2 (FIG. 16C) is changed from 5V to 0V, the transfer thyristor 2' has the anode potential 5V, the cathode potential 0V and the gate potential 3.7V, whereby the transfer thyristor 2' is on. After the transfer thyristor 2' is on, the signal Φ1 is changed from 0V to 5V, whereby the transfer thyristor is off like the light emission thyristor 1.

Thus, the on of the transfer thyristor is shifted from the thyristor 1' to the thyristor 2'. Then, if the signal ΦI is changed from 5V to 0V, the light emission thyristor 2 becomes on and the LED is lit. The reason why the LED can be lit by using only the light emission thyristor corresponding to the transfer thyristor being on is as follows. Namely, if the transfer thyristor is not on, since the gate voltage except for the thyristor adjacent to the thyristor being on is 0V, the on condition of the thyristor is not satisfied. If the light emission thyristor with respect to the adjacent thyristor turns on, the signal Φ has the potential 3.4V (i.e., corresponding to the forward-direction voltage drop of the light emission thyristor). Thus, the adjacent thyristor does not have the potential difference between its gate and cathode, and so the thyristor can not be turned on.

Figures 16A, 16B, 16C, 16D, 16E, 16F:
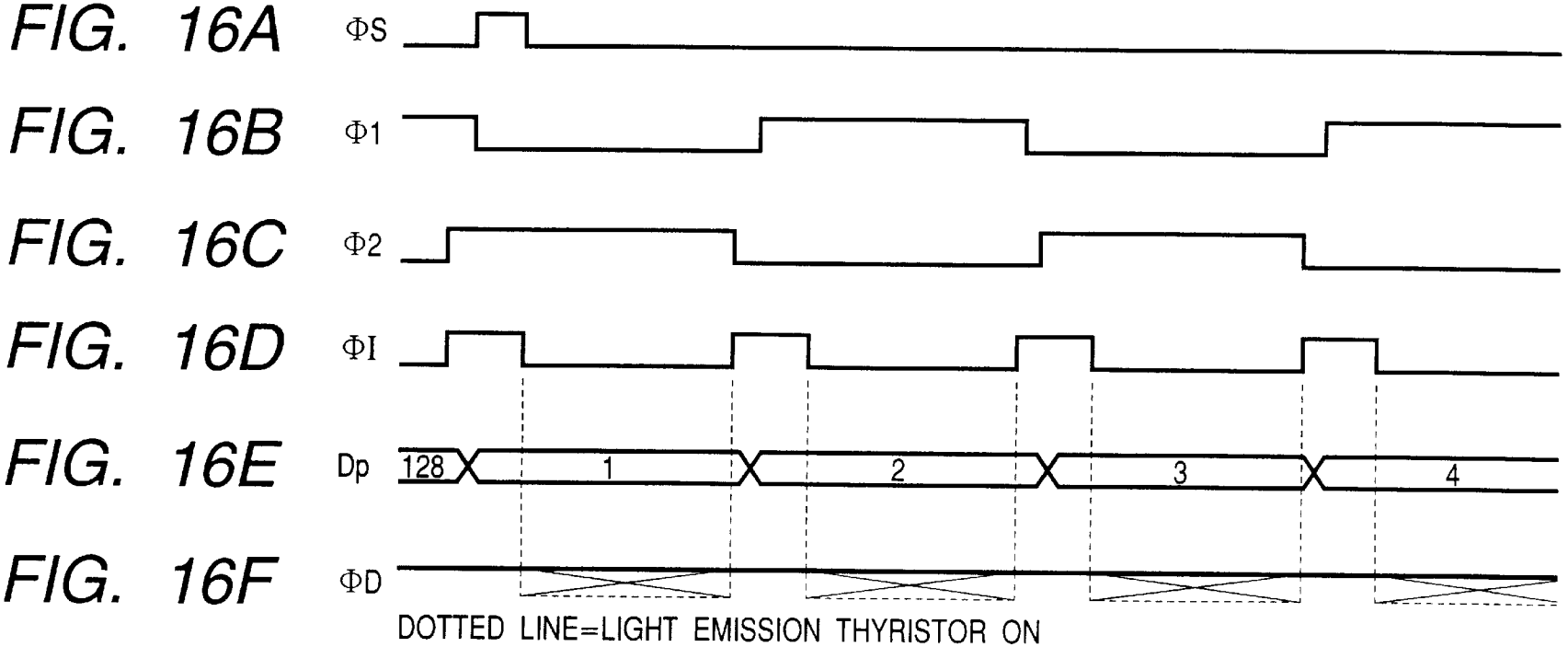
FIGS. 16A, 16B, 16C, 16D, 16E and 16F are timing charts for controlling the SLED.

In the above explanation, if the signal ΦI is changed to 0V, the light emission thyristor is on, whereby the LED is lit. However, in the actual image formation operation, it is necessary to control whether or not the LED is to be truly lit at such timing in accordance with the image data. Image data Dp of FIG. 16E and a signal ΦD of FIG. 16F represent such an operation. At the terminal of signal ΦI of the SLED, a logical sum (OR) between the signal ΦI and the image data Dp is externally given. Then, only if the image data Dp is 0V, the terminal of the signal ΦI of the SLED actually becomes 0V, and the SLED is lit. Conversely, if the image data Dp is 5V, the terminal of the signal ΦI of the SLED is maintained to be 5V, and the SLED is not lit.

Figure 17:
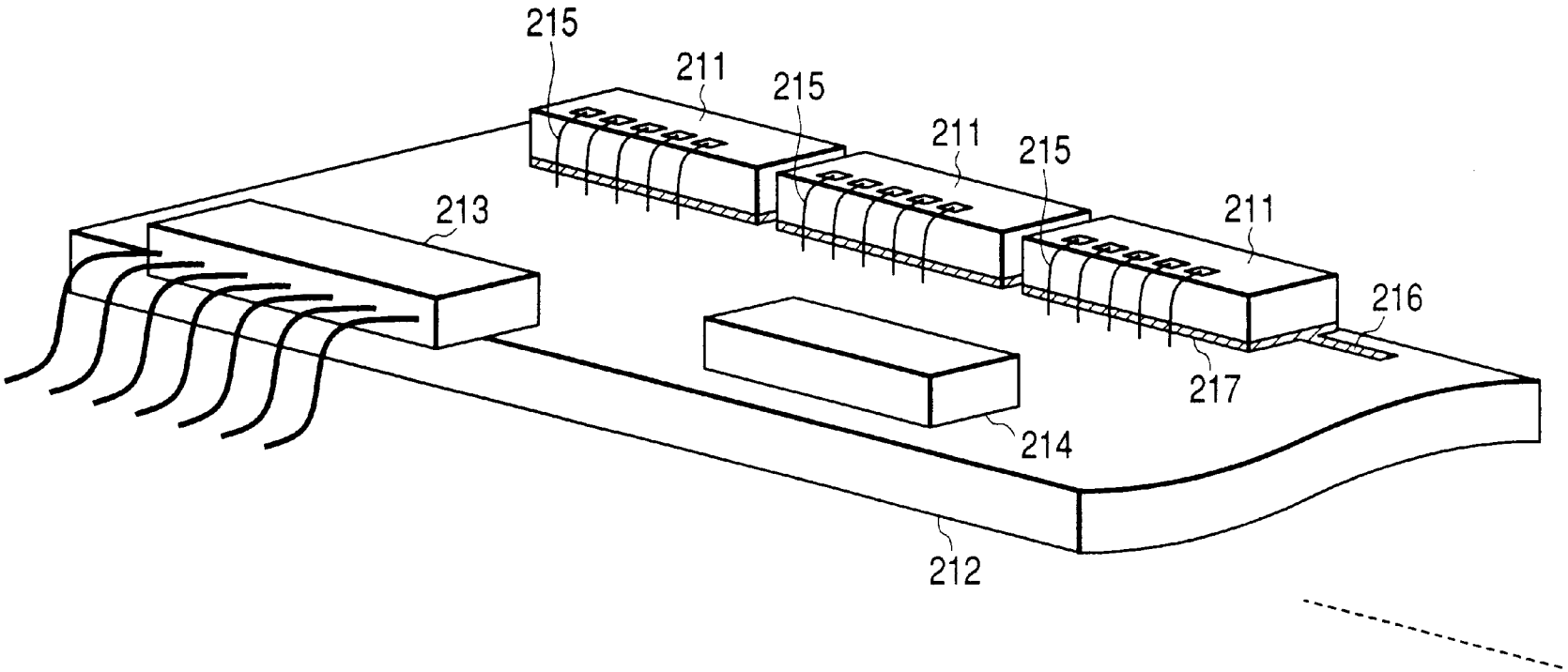
FIG. 17 is an external perspective view showing an example of the structure on which an SLED array head is actually mounted.

Here, the method to structure the SLED array head will be explained with reference to FIG. 17.

A base substrate 212 which uses printed wiring board made of a glass epoxy material, a ceramic material or the like is mounted with SLED semiconductor chips 211. A lighting control circuit (i.e., a driver IC) 214 is externally supplied with a control signal and generates a lighting control signal for the SLED semiconductor chip 211. The external control signal and power are input and supplied to each semiconductor through a connector 213. Since bonding wires 215 are connected to the SLED semiconductor chip 211, the output signals (Φ1, Φ2, ΦS, ΦI and anode-side power (i.e., GND in this example) are input. Numeral 216 denotes a cathode-side power supply pattern (+5V in this example) which is drawn on the base substrate 212. Numeral 217 denotes a silver paste by which the cathode-side power supply pattern 216 and the back-face electrode of the SLED semiconductor chip 211 are electrically conductive and fixedly adhered to each other.

Incidentally, in recent years, an image formation apparatus which forms each of four color images (i.e., yellow, magenta, cyan and black images) on the photosensitive drum for each color, overlaps the formed images, transfers the overlapped image to one sheet, fixes the transferred image and outputs the sheet has been put to practical use.

Figure 18:
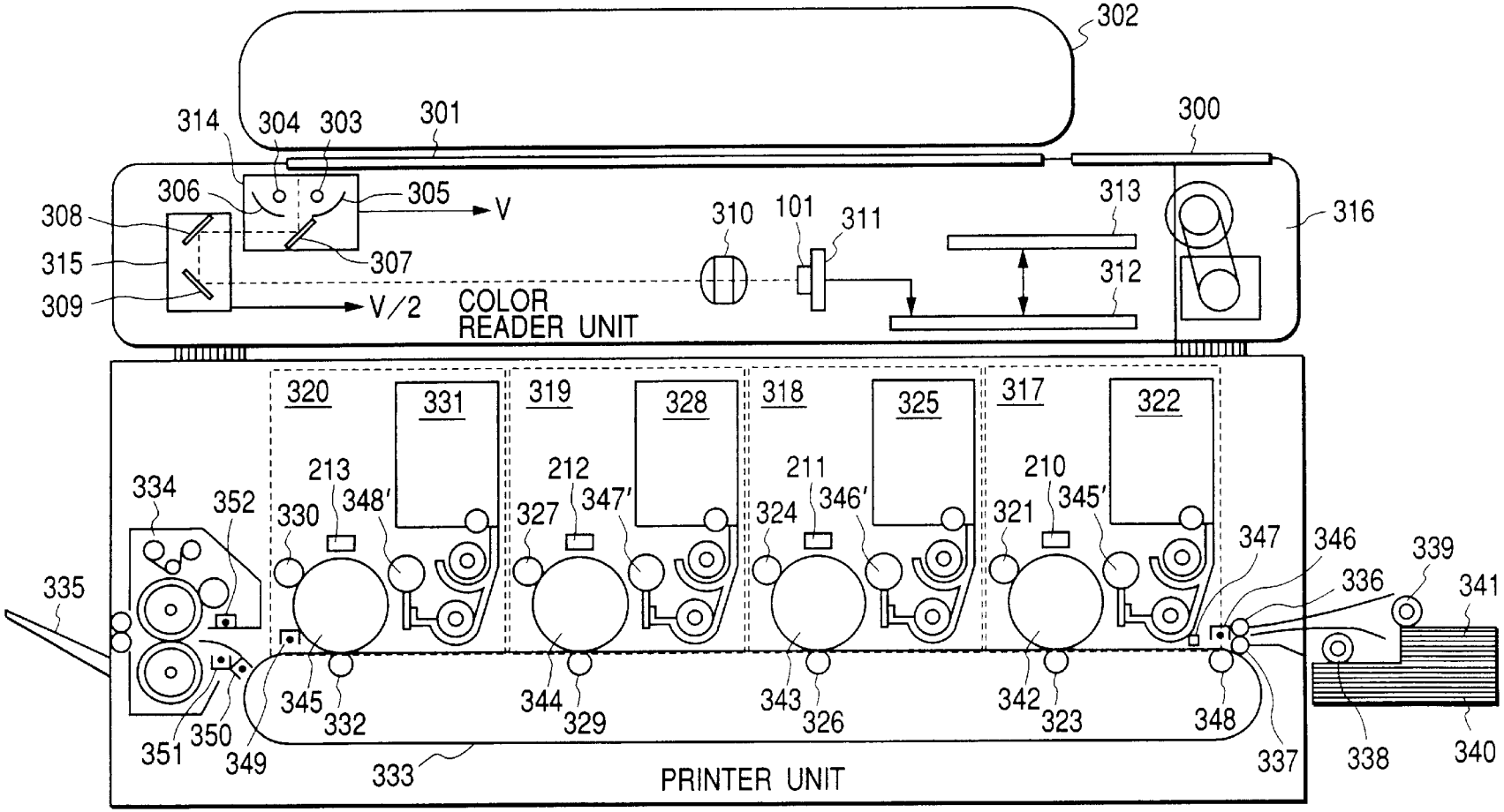
FIG. 18 is a sectional view showing an example of a color image formation apparatus which uses the SLED array head.

FIG. 18 is a sectional view showing an example of such a color image formation apparatus. First, the structure of a color reader unit will be explained with reference to FIG. 18.

A CCD 101 is mounted on a substrate 311. Numeral 312 denotes a printer processing unit, and numeral 301 denotes an original mounting board glass (platen). Numeral 302 denotes an original feeder. Instead of the original feeder 302, a specular surface pressure board (not shown) or a white pressure board (not shown) may be applied. As light sources 303 and 304, halogen lamps or fluorescent lamps are used to illuminate an original. Light from the light source 303 is concentrated on the original by a reflection umbrella 305, and light from the light source 304 is concentrated on the original by a reflection umbrella 306. Numerals 307, 308 and 309 denote mirrors. Reflection light or projection light from the original is concentrated on the CCD 101 by a lens 310.

A carriage 314 includes the halogen lamps 303 and 304, the reflection umbrellas 305 and 306, and the mirror 307. A carriage 315 includes the mirrors 308 and 309. Numeral 313 denotes an interface (I/F) unit to another image processing unit (IPU) or the like. The carriages 314 and 315 mechanically move toward the direction perpendicular to the electrical scan (main scan) direction at speeds V and V/2, respectively, thereby scanning (sub-scanning) the entire face of the original.

Next, the structure of the printer unit in FIG. 18 will be explained.

Numeral 317 denotes a magenta (M) image formation unit, numeral 318 denotes a cyan (C) image formation unit, numeral 319 denotes an yellow (Y) image formation unit, and numeral 320 denotes a black (K) image formation unit. Since the structures of the M, C, Y and K image formation units are identical, only the M image formation unit 317 will be explained in detail, and explanation of other image formation units will be omitted.

In the M image formation unit 317, a latent image is formed on the surface of a photosensitive drum 342 by using light from an LED array 210. A primary charger 321 charges the surface of the photosensitive drum 342 up to a predetermined potential, to prepare latent image formation. A development unit 322 develops the latent image on the photosensitive drum 342 to form a toner image. The development unit 322 includes a sleeve which is used to apply development bias.

A transfer charger 323 discharges from the back face of a transfer member carrying belt 333, to transfer the toner image on the photosensitive drum 342 to a recording sheet or the like on the belt 333. Since the operation in the embodiment is performed on the assumption that the structure having satisfactory transfer efficiency is applied (e.g., by optimizing physical characteristics of toner), any cleaner unit is not disposed. However, it is needless to say that the cleaner unit may be disposed.

The black (K) image formation unit 320 comprises components 331, 348', 213, 330, and 345 that are similar to the components 332, 345', 210, 321, and 342, respectively, of the magneta (M) image formation unit 317, the cyan (C) image formation unit 318 comprises components 325, 346', 211, 324, and 343 that are similar to the components 332, 345', 210, 321, and 342, respectively, of the magenta (M) image formation unit 317, and the yellow (Y) image formation unit 319 comprises components 328, 347', 212, 327, and 344 that are similar to the components 332, 345', 210, 321, and 342, respectively, of the magenta (M) image formation unit 317. Accordingly, those components of the units 318–320 will not be described in further detail herein.

Next, the procedure to transfer the toner image onto the transfer member such as the recording sheet or the like will be explained.

The transfer member such as the recording sheet or the like held in a cassette 340 or 341 is fed one by one by a pickup roller 338 or 339, and supplied to the carrying belt 333 by sheet feed rollers 336 and 337. The supplied recording sheet is charged by an adsorption charger 346. The carrying belt 333 is driven by a transfer member carrying belt roller 348, and the recording sheet is charged by the adsorption charger 346, whereby the recording sheet is adsorbed to the belt 333. It should be noted that the transfer member carrying belt roller 348 may be used as the driving roller to drive the transfer member carrying belt 333, or a driving roller to drive the belt 333 may be disposed on the opposite side.

A sheet leading edge sensor 347 detects the leading edge of the recording sheet on the transfer member carrying belt 333. A detection signal from the sensor 347 is transferred from the printer unit to the color reader unit, and used as a sub-scan sync signal when a video signal is transferred from the color reader unit to the printer unit.

After then, the recording sheet is carried by the transfer member carrying belt 333, and the toner images are formed on the sheet by the image formation units 317 to 320 in the order of M, C, Y and K. The transfer member such as the recording sheet passed the K image formation unit 320 is charge eliminated by a charge elimination charger 349 such that the sheet can easily separated from the carrying belt 333. Then the recording sheet is actually separated from the belt 333. In this case, image disturbance which is caused by separation discharge when the recording sheet is separated from the carrying belt 333 can be prevented by a separation charger 350. The separated recording sheet is charged by prefixing chargers 351 and 352 to compensate toner adsorption and thus prevent image disturbance. Then the toner image is thermally fixed by a fixing unit 334, and the sheet is discharged onto a sheet discharge tray 335.

Next, driving timing of the LED arrays 210, 211, 212 and 213 will be explained.

When the SLED chip is used as the LED array, the above-mentioned four light emission control signals are necessary for each LED array. Namely, the start clock ΦS for returning the light emission position to the first bit, the transfer clocks Φ1 and Φ2 for changing afterward the light emission position one bit by one bit, and the clock ΦI acting as the lighting timing signal if the light emission thyristor is actually lit at the selected light emission position are necessary.

The generation circuit of the light emission control signals will be explained with reference to a block diagram shown in FIG. 19 and timing charts shown in FIGS. 20A, 20B, 20C, 20D, 20E, 20F, 20G and 20H.

Figure 19:
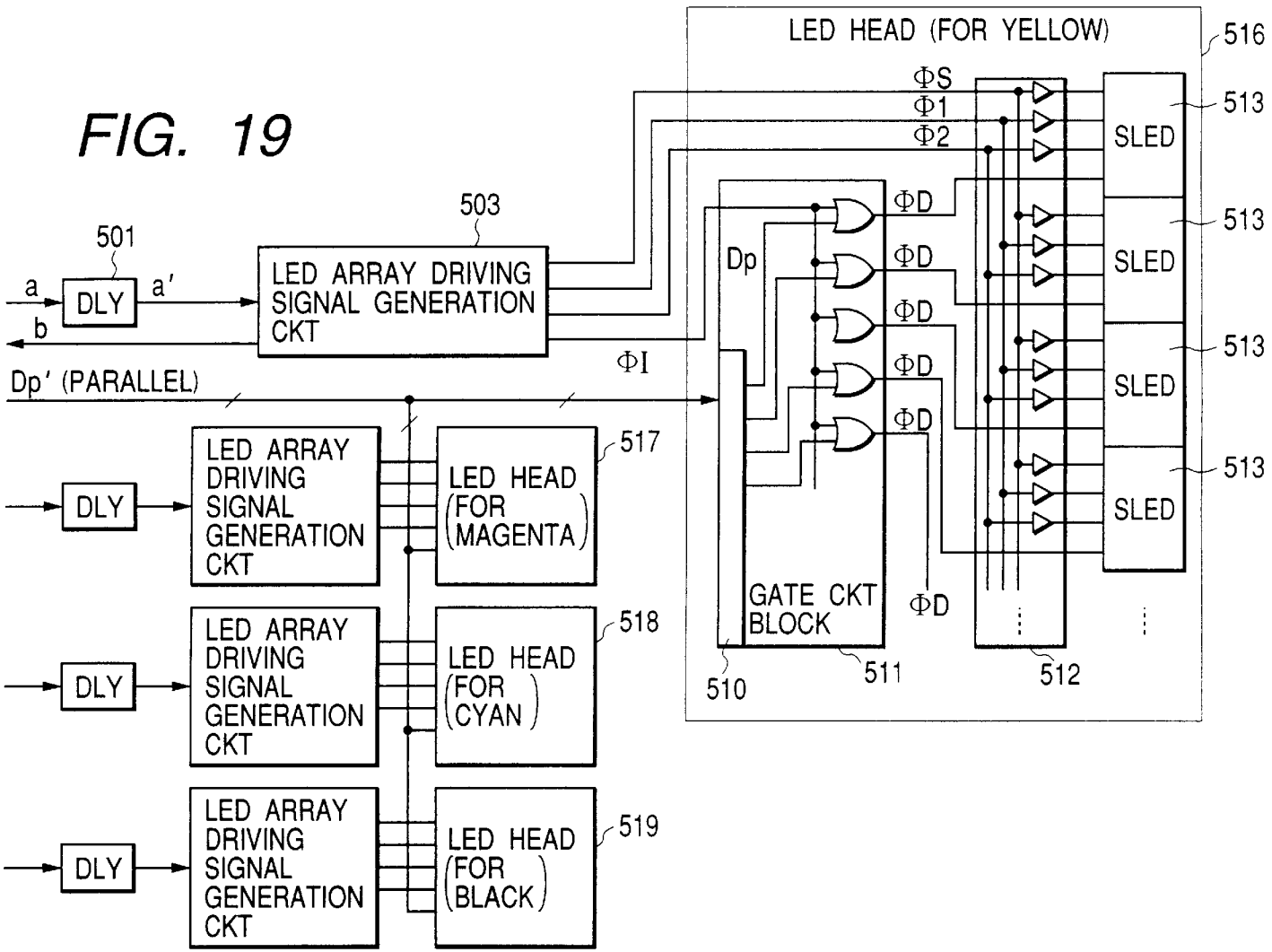
FIG. 19 is a circuit diagram showing the structure for controlling light emission of the LED array head.
Figures 20A, 20B, 20C, 20D, 20E, 20F, 20G, 20H:
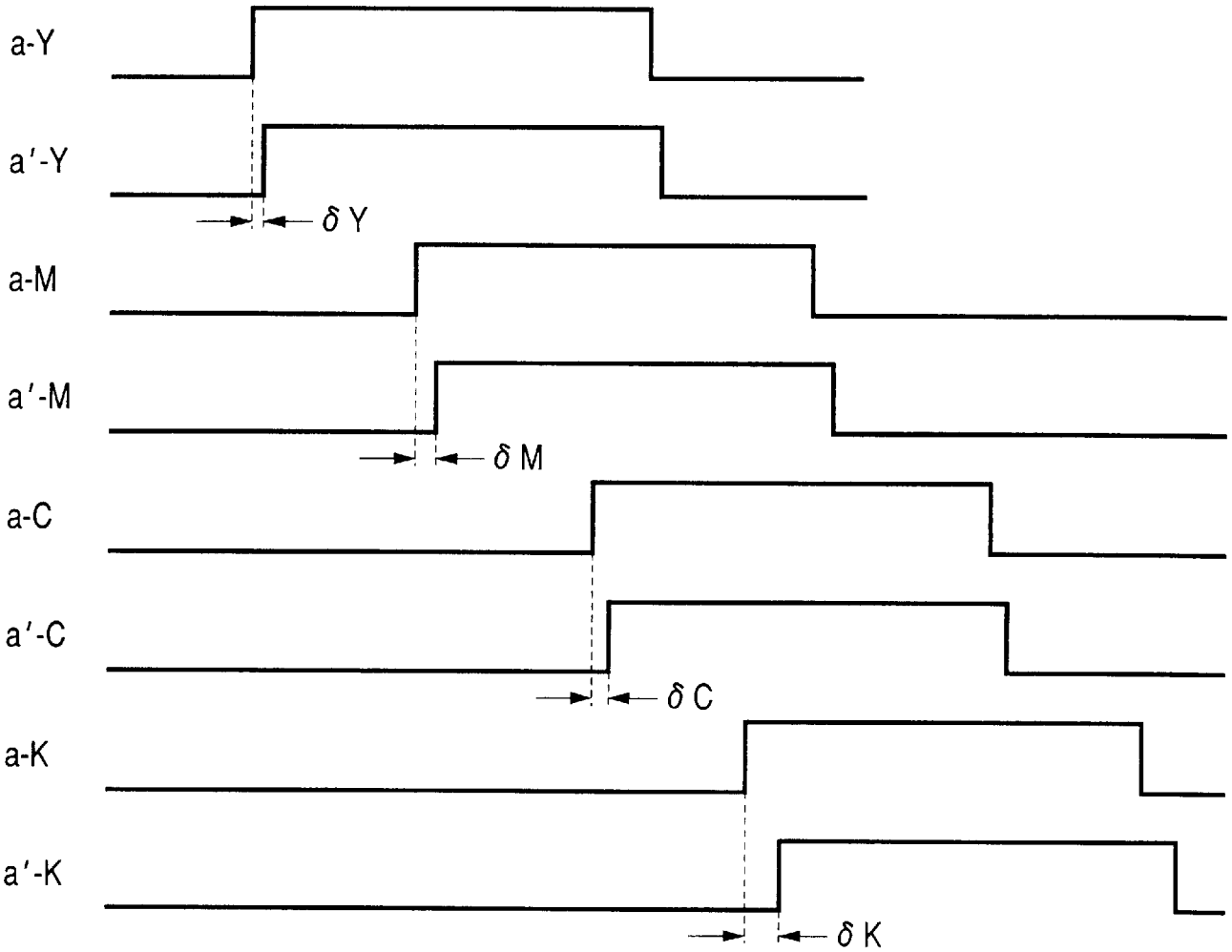
FIGS. 20A, 20B, 20C, 20D, 20E, 20F, 20G and 20H are timing charts for explaining correction of positional deviation in a sub-scan direction in the circuit structure of FIG. 19.
Figure 21:
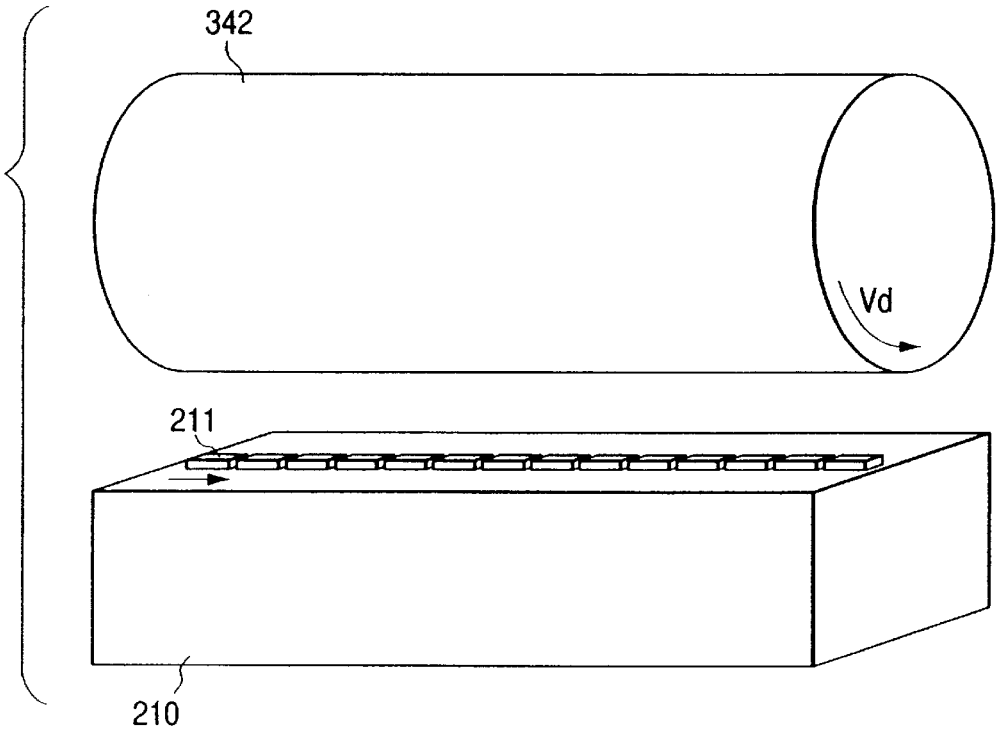
PRIOR ART FIG. 21
FIG. 21 is a perspective view for explaining conventional problems.
Figure 22:
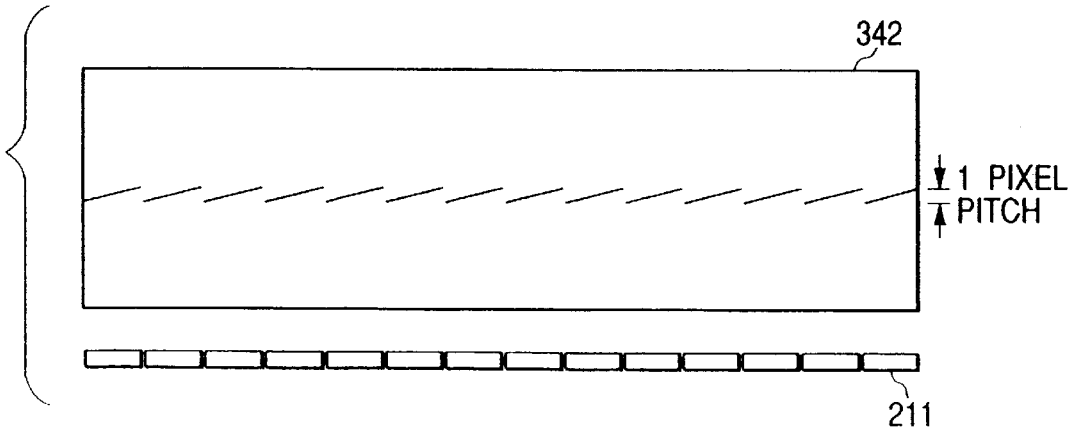
PRIOR ART FIG. 22
FIG. 22 is a view for explaining the conventional problem.

In FIG. 19, a character a denotes an image enable signal which is sent from a main controller (i.e., an image data controller, which is not shown) of the image formation apparatus. The image enable signal a starts up at the recording sheet passing timing detected by the sheet leading edge sensor 347, and acts as the sub-scan sync signal which represents the timing at which the LED array should start the writing to form the image at the predetermined position of the recording sheet. A delay circuit 501 delays the image enable signal a by later-described timing independently designated, so as to correct positional dispersion of the light emission point array of the LED array head in the sub-scan direction. Then the delay circuit 501 outputs a delayed image enable signal a'.

The positional dispersion of the light emission point array of the LED array head in the sub-scan direction is occurred by various factors, e.g., dispersion of positional accuracy on the LED array head side, dispersion or variation of accuracy of positioning member of each unit on the image formation apparatus side, dispersion or variation of relative positions between the LED array unit and the body of the image formation apparatus in mounting and conveying, and the like. If the writing position by the LED array on the photosensitive body is dispersed or varied by the above factors in the sub-scan direction, the images of the four colors are overlapped with dispersion in the sub-scan direction by a certain quantity, and the color image is formed. Thus, it is needless to say that a satisfactory output image can not be obtained.

Therefore, a delay time corresponding to the positional dispersion quantity of the light emission point array in the sub-scan direction which has been previously recognized by various methods is set to each delay circuit. Thus, the correction to delay the sub-scan direction sync signal sent from the body of the apparatus by the predetermined timing is performed.

The timing charts shown in FIGS. 20A to 20H show such the correction. In the drawings, symbols δY, δM, δC and δK denote delay quantities which are controlled by the setting and different for respective colors.

Again in FIG. 19, numeral 516 denotes one LED array head, and numeral 513 denotes SLED chips.

The image enable signal a' delayed as above is supplied to an LED array driving signal generation circuit 503. The LED array driving signal generation circuit 503 which is composed of combination order circuits starts at the input timing of the delayed image enable signal a' to generate the above-mentioned light emission control signals ΦS, Φ1, Φ2 and ΦI.

When the LED array driving signal generation circuit 503 receives the delayed image enable signal a', it returns an image data request clock b to a main controller (not shown). In synchronism with the image data request clock b, the main controller inputs a parallel image data Dp' to the yellow LED array head 516.

In this case, the LED array head uses the 56 SLED chips per one head, and the light emission point in one chip is made by 128 bits. Thus, 56 signals each including image data from one bit to 128 bits in series corresponding to each chip position must be essentially input in parallel. However, if 56 data input lines are provided in the LED array head, the number of connection cables seriously increases, whereby problems occur in management and cost of the cables.

For this reason, it is used the system in which the data is transmitted/received eight times by using the seven parallel signals within one-bit lighting timing, thereby transferring the total 56-bit data. A data conversion block 510 in FIG. 19 converts the image data Dp' to distribute the parallel data to the 56 SLED chips.

Numeral 511 denotes a gate circuit block which calculates logical sum (OR) between the image data Dp distributed by the data conversion block 510 to each chip and the light emission control signal ΦI and outputs the obtained result. Thus, the signal ΦI being L is supplied only to the SLED chip in which the image is on. In this case, if the image data ΦD is H, the terminal of the signal ΦI of the SLED chip 513 is maintained to be H, and any light emission is not performed. Conversely, if the image data ΦD is L, the signal ΦI from the LED array driving signal generation circuit 503 passes through the gate circuit block 511 as it is. Thus, the terminal of the signal ΦI of the SLED chip 513 is L during its L period, whereby light emission is performed.

Numeral 512 denotes a buffer block which distributes the output signals ΦS, Φ1 and Φ2 from the LED array driving signal generation circuit 503 to the six SLED chips 513. Since the signal ΦI is independently generated by the gate circuit block 511 for each SLED chip 513, an internal buffer is not included for the signal ΦI in this case.

The above-mentioned structure is independently provided for each of the yellow LED array head 516, a magenta LED array head 517, a cyan LED array head 518, and a black LED array head 519. Although the same structure is provided for each of Y, M, C and K in FIG. 19, only the structure for Y has been explained in detail. The same structure as above is applied to other three colors (i.e., M, C and K).

First Embodiment

Figure 1:
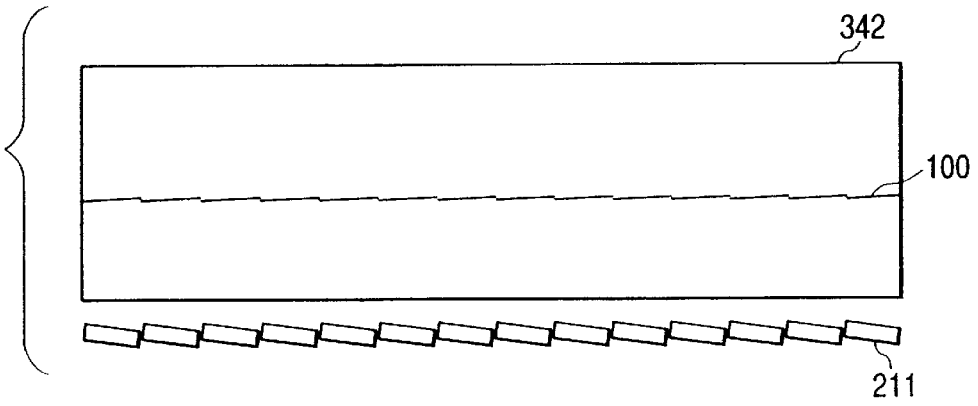
FIG. 1 is a schematic view showing an example that LED array chips according to the first embodiment of the present invention are disposed, and an example of a writing line on a photosensitive drum when repetition speed in sub-scanning is doubled.

FIG. 1 shows a structural example of the LED array chips 211 and an example of a writing line 100 on the photosensitive drum 342, according to the first embodiment of the present invention.

Figure 2:
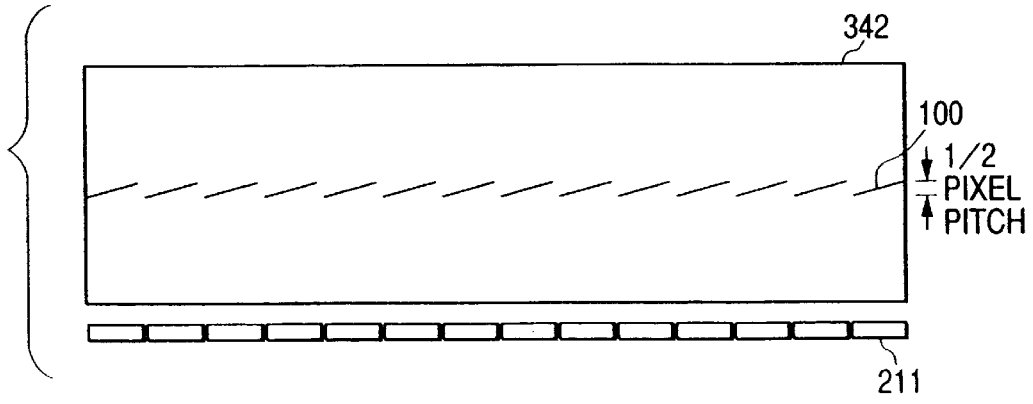
PRIOR ART FIG. 2
FIG. 2 is a schematic view showing a writing line on the photosensitive drum in a case where the plural LED array chips are aligned, for the comparison with the effect shown in FIG. 1.

FIG. 2 is a schematic view showing the effect which is to be compared with the effect of the present embodiment shown in FIG. 1. Namely, FIG. 2 shows the writing line in the case where the plural LED array chips 211 are aligned, same as in the conventional example. In this case, on the writing line 100, sawtoothed nonconformity with chip width occurs.

Even if the repetition speed in sub-scanning is not changed and the respective LED array chips 211 are obliquely mounted, the writing line 100 on the photosensitive drum 342 can be made linear with full width of main scan. Namely, it is assumed that the rotating speed of the photosensitive drum 342 is Vd, and the repetition period of sub-scanning is Ts. In this case, if the LED array chips 211 are made linear as shown in FIG. 2, the difference S=Vd×Ts=Pv (Pv is the light emission pixel pitch of the LED array chip) in the writing position sub-scan direction occurs. Thus, if the LED array chips 211 are obliquely mounted such that the chip oblique mounting width dS=Pv, the difference S' in the writing position sub-scan direction becomes substantially S'=S−dS=0.

FIG. 1 shows the example in the case where the repetition speed in sub-scanning is doubled. Since the repetition speed in sub-scanning is doubled, the repetition period in sub-scanning becomes Ts/2. Therefore, in this condition, when the LED array chip 211 is aligned as shown in FIG. 2, the sawtoothed difference S is given as follows:

$$S=Vd\times Ts/2 \tag{1}$$

This difference is ½ of the conventional difference S. However, the movement quantity of the photosensitive drum 342 in the sub-scan direction during one scan line is ½ of the main-scan image pitch (i.e., the light emission pixel pitch).

In this state, the sawtoothed difference of ½ of the main scan image pitch still remains.

Therefore, in order to solve this problem, in the present embodiment, the LED array chips 211 are obliquely mounted like the sawteeth by ½ of the main-scan image pitch, with respect to the line perpendicular to the sub-scan direction, as shown in FIG. 1. Thus, the sawtoothed difference caused by the rotation of the photosensitive drum 342 in the sub-scan direction is compensated, whereby the optical writing line 100 becomes substantially linear, as shown in FIG. 1.

In FIG. 1, the optical writing line 100 is not completely linear, because the dispersion of various physical constants such as mounting position accuracy and the like of the LED array chip 211 is assumed. Ideally, the writing line 100 is completely linear.

As shown in FIG. 1, the repetition speed of the writing line in sub-scanning is set to n times the main-scan resolution, and each LED array chip 211 is obliquely mounted or the light emission element array is obliquely disposed on the LED array chip 211, by 1/n of the main-scan pixel length with respect to the line perpendicular to the sub-scan direction. Thus, as shown in FIG. 1, only by obliquely mounting each LED array chip 211 or obliquely disposing the light emission element array on the LED array chip 211, an oblique mounting angle of the LED array chip 211 is eased as compared with the case where the sawtoothed difference of the writing line is intended to be eliminated, whereby there is obtained the advantage that there is little need to narrow the pitch of the light emission points.

Figure 3:
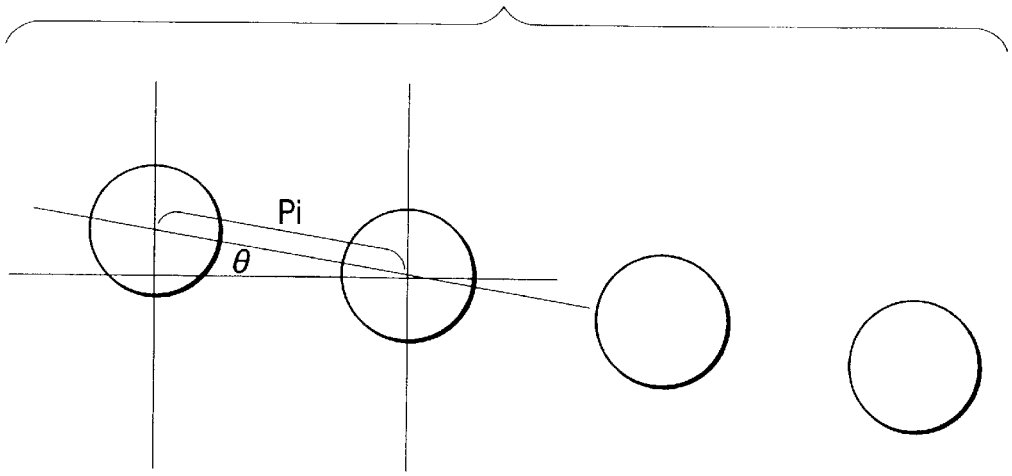
FIG. 3 is a view for explaining the principle of the first embodiment of the present invention.

The principle of this advantage will be explained in detail with reference to FIG. 3. When the LED array chip having light-emission point pitch Pi is obliquely mounted by an angle θ with respect to the line perpendicular to the sub-scan direction, the writing pitch in the main-scan direction on the photosensitive drum is Pi×cos θ. Namely, the pitch is reduced by Pi×(1−cos θ). Such narrowing of the pitch is eased by the present embodiment.

Figure 4:
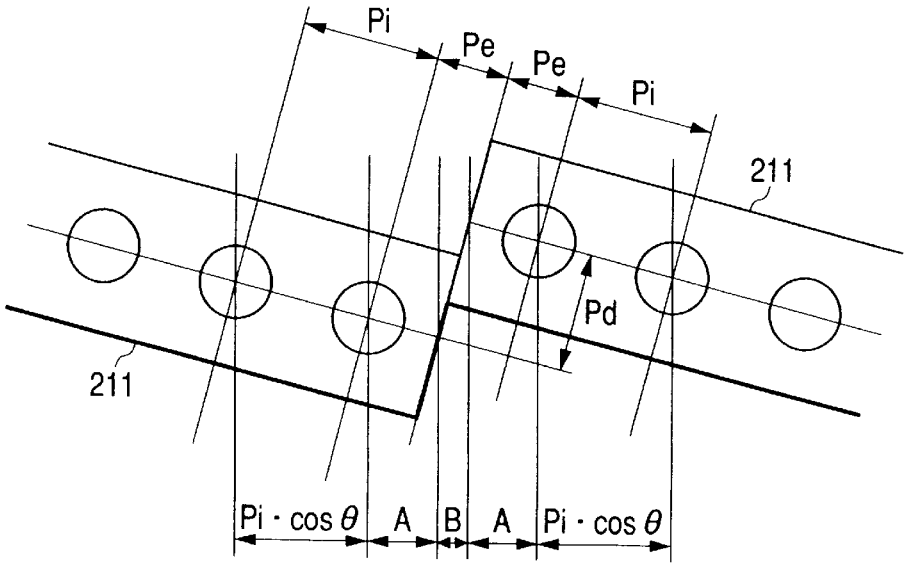
FIG. 4 is a view for explaining that, when the LED array chips are obliquely mounted, a gap allowance at the joint of the chips becomes smaller according as an angle becomes larger, whereby chip mounting itself becomes difficult.

Further, when the LED array chip is obliquely mounted, as the angle increases, a gap clearance at the chip connection portion decreases, whereby chip mounting itself becomes difficult. This phenomenon will be explained with reference to FIG. 4. FIG. 4 assumes that the ends of the adjacent LED array chips 211 just come into contact with each other. It is assumed that the distance between the center of the light emission pixel and the end of the chip is Pe, and the distance between the lines each passing through the center of the light emission points and respectively in parallel with the longitudinal direction of the chips is Pd. In this case, a writing pitch A+B+A of the end light emission pixels of the two chips in the main scan direction on the photosensitive drum 342 is given as follows:

$$A+B+A=Pe\cdot\mathrm{COS}\ \theta+Pd\cdot\sin\theta+Pe\cdot\cos\theta \tag{2}$$

If the distance between each end light emission pixel and the chip end is made smaller by than ½ of the light emission pixel pitch within the chip, the following equations obtain:

$$A+B+A=Pd\cdot\sin\theta+2Pe\cdot\cos\theta=Pd\cdot\sin\theta+(2Pe\cdot\cos\theta+2\alpha\cdot\cos\theta)-2\alpha\cdot\cos\theta=Pd\cdot\sin\theta+Pi\cdot\cos\theta-2a\cdot\cos\theta \tag{3}$$

At the chip connection portion, if the writing pitch in the main scan direction on the photosensitive drum 342 is made the same as that within the chip, it is necessary to set the parameters Pd, α and θ as follows and form the chip:

$$Pd\cdot\sin\theta<2\alpha\cdot\cos\theta \tag{4}$$

The above calculation is a trial in the case where the chip ends are in contact with each other. However, if there is no actual space wider than a certain quantity between the chip ends, the chip can not be mounted. Further, it is necessary to reduce the left side and enlarge the right side as much as possible.

According to the present invention, the angle θ can be set small, whereby the parameter α need not meet requirements as stringent as would otherwise be the case.

Second Embodiment

For example, in such the image formation apparatus as finally an output image formed on an output sheet is thermally fixed, when a cardboard or an OHP (overhead projector) sheet is used as the output sheet, it may be necessary to suppress the speed of image formation process for the system as a whole for the purpose of securing the fixing stability.

In the second embodiment of the present invention, if the movement speed of the photosensitive drum 342 in the sub-scan direction decreases to a predetermined value, the main scan speed is decreased according to the decrease in the drum speed, thereby preventing excessive correction due to the oblique mounting of the chip. Hereinafter, the second embodiment of the present invention will be explained with reference to FIGS. 5 and 6.

Figure 5:
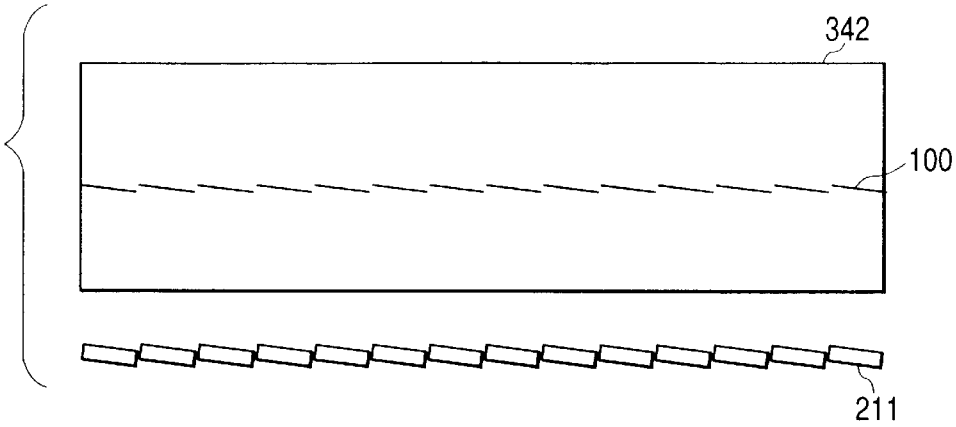
FIG. 5 is a schematic view showing that, if the movement speed of the photosensitive body in the sub-scan direction is lowered to a predetermined value in the LED array chip disposing structure, correction is performed excessively, thereby generating sawtoothed nonconformity in the opposing direction.
Figure 6:
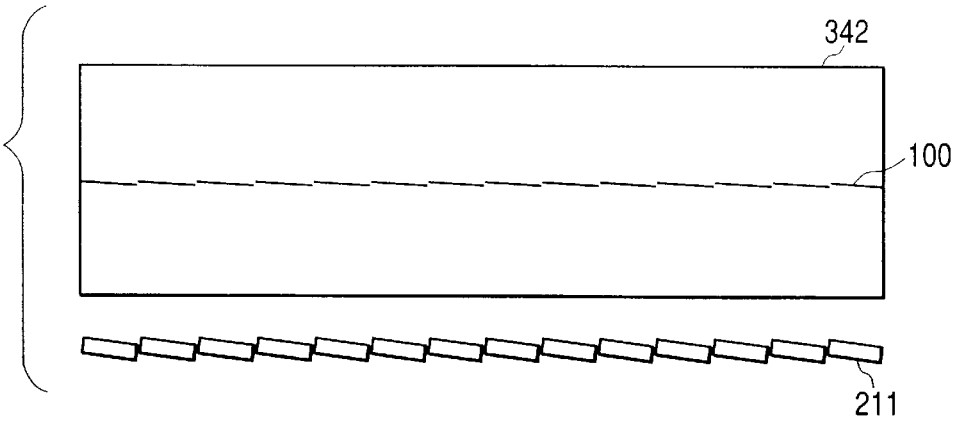
FIG. 6 is a schematic view showing an example that LED array chips according to the second embodiment of the present invention are disposed, and an example of a writing line on the photosensitive drum.

In such the structure of FIG. 1 as described in tie first embodiment, it is assumed that the speed the photosensitive drum 342 changes from Vd to Vd/2. If the repetition period in sub-scanning is Ta/2, the sawtoothed difference at the writing position of the light emission point array S' becomes Pv/4 (Pv is the light emission pixel pitch of the LED array) due to the movement of the photosensitive drum 342 in the sub-scan direction and the scan light emission, and the oblique mounting width dS of the LED array chip becomes ½Pv, whereby the oblique mounting width is excessively corrected by ¼Pv. Thus, the sawtoothed difference occurs at the opposite side as shown in FIG. 5.

Thus, in the present embodiment, if the speed of the photosensitive drum 342 is reduced by half, it is controlled to decrease the main scan period to Ta, whereby the difference of the recording position in the sub-scan direction is made zero as well as the ordinary-time speed.

If the image formation apparatus sets the intermediate speed other than one for integer (i.e., to 1/x, where x is not an integer), the main scan period may be set from the value corresponding to n times the predetermined main scan resolution to the value corresponding to 1/x times that resolution. However, in the system in which the repetition speed in sub-scanning can not be continuously changed, it is possible to apply a method for selecting a less-difference period from the value capable of being set.

The present invention is applicable to a system composed of plural pieces of equipment (e.g., a host computer, an interface equipment, a reader, a printer and the like) or to an apparatus including a single piece of equipment (e.g., a copying machine, a facsimile machine or the like).

As explained above, according to the present embodiment, the number of main scans of the writing line on the photosensitive body at the predetermined movement speed of the photosensitive body in the sub-scan direction is set to have the value corresponding to n times the main scan resolution, and each LED array chip is obliquely mounted or the light emission element array on the LED array chip is obliquely formed by 1/n of the main scan pixel length. Thus, it is possible to make the writing line linear without excessively increasing the main scan speed and without obliquely mounting the chip at the excessive angle.

Further, if the movement speed of the writing medium in the sub-scan direction decreases to the predetermined value, the repetition speed in sub-scanning is decreased according to the decrease in the medium speed. Thus, the excessive correction due to the oblique mounting of the chip can be eliminated.

Further, the correction quantity due to the oblique mounting can be decreased by setting the main scan speed n times the main scan resolution. Thus, even if one kind of head is used in the image formation apparatus having the lower movement speed in the sub-scan direction other than the image formation apparatus having the previously assumed movement speed in the sub-scan direction, the difference generation quantity due to the excessive correction can be reduced.

Third Embodiment

Figure 7:
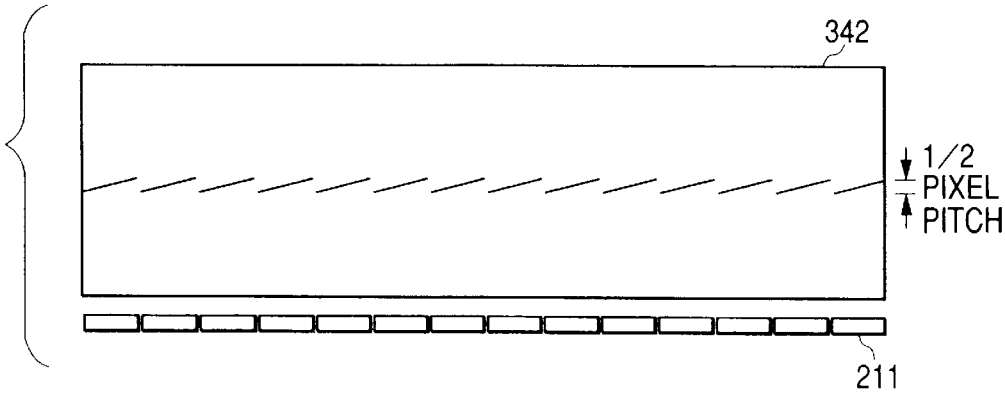
FIG. 7 is a schematic view showing LED array light emission control in an optical scan apparatus and an image formation apparatus according to one embodiment of the present invention.

FIG. 7 shows, together with the LED array chips, an example of the recording line which is formed on the photosensitive drum when the main scan speed is doubled in an optical scan apparatus and an image formation apparatus according to the third embodiment of the present invention. In the third embodiment, since the repetition speed is doubled, the main scan period is ½ of the conventional period (i.e., Ts/2). Therefore, the sawtoothed difference in the sub-scan direction is given as follows:

$$Vd \times Ts/2 \tag{5}$$

This is ½ of the conventional sawtoothed difference. At this time, the movement quantity of the photosensitive drum in the sub-scan direction during one scan line corresponds to the half (½ pixel) of the main-scan image pitch.

Therefore, according to the present embodiment, in the above state, the image data and the LED array driving signal are controlled as described later, whereby image resolution and the number of gradations in the sub-scan direction can be selected and changed from among plural combinations.

Figure 8:
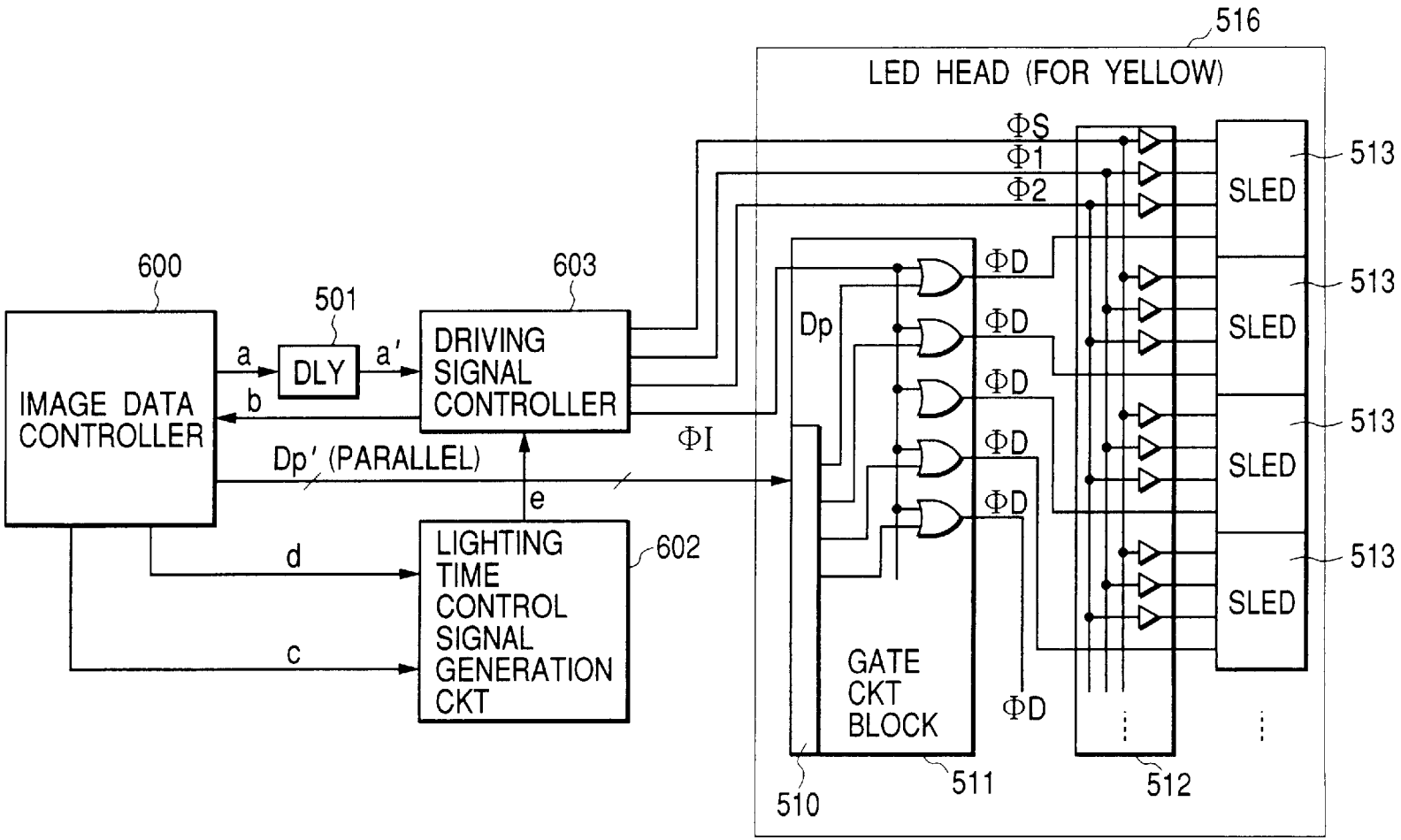
FIG. 8 is a circuit diagram showing a control block structure for an image signal and an LED array driving signal in the optical scan apparatus and the image formation apparatus according to one embodiment of the present invention.

FIG. 8 is a circuit diagram showing a control block structure for the image signal and the LED array driving signal according to the present embodiment of the present invention. In FIG. 8, the same structural elements as those shown in FIG. 19 are added with the same reference numerals respectively, and explanation thereof will be omitted. Although the identical structure is essentially provided for yellow (Y), magenta (M), cyan (C) and black (K), the structure only for Y is illustrated in FIG. 8. The same structure as that for Y is independently applied for each of other three colors (i.e., M, C and K). Such structure is independently provided for one LED array head 516.

Numeral 600 denotes an image data controller which outputs a sub-scan direction image resolution change signal c and a gradation number change signal d to a lighting time control signal generation circuit 602. The switch signals c and d respectively correspond to a resolution selection signal and a gradation selection signal. Thus, the lighting time control signal generation circuit 602 outputs a later-described light time control signal a corresponding to the timing control signal to a driving signal controller 603 including the same structure as that of the LED array driving signal generation circuit 503, in accordance with both the resolution selection signal and the gradation selection signal. On the basis of the main control block of the image formation apparatus or the signals c and d externally (not shown) input, the image data controller 600 causes the lighting time control signal generation circuit 602 to generate the lighting time control signal e.

In accordance with the lighting time control signal e, the driving signal controller 603 controls the lighting time of the lighting enable signal ΦI common to all the chips to the value according to the predetermined number of gradations. Thus, the image resolution and the number of gradations are selected and changed. The procedure of the lighting time control will be explained in detail by way of example of various operation conditions.

For example, it is assumed that the main-scan image resolution (i.e., the light emission pixel pitch) is 600 dpi and the main scan speed corresponds to 1200 dpi (i.e., twice as much as the main-scan image resolution). In this case, an example of the combination of the sub-scan direction image resolution and the number of gradations which can be concretely structured will be explained with reference to timing charts shown in FIGS. 9A, 9B, 9C, 9D, 9E, 9F, 9G, 10A, 10B, 10C, 10D, 10E, 10F, 10G, 11A, 11B, 11C, 11D 11E, 11F, 11G, 12A, 12B, 12C, 12D, 12E, 12F, 12G, 13A, 13B, 13C, 13D, 13E, 13F, 13G, 14A, 14B, 14C, 14D, 14E, 14F and 14G.

First, the case where the sub-scan image resolution is 600 dpi and the number of gradations is the binary value will be explained as a first example. The timing charts of this first example are shown in FIGS. 9A to 9G and FIGS. 10A to 10G. FIGS. 9A to 9G show the timing charts for odd lines (i.e., (2m−1)th line), and FIGS. 10A to 10G show the timing charts for even lines (i.e., 2m-th line). The light emission control for the main scan in the timing shown in FIGS. 9A to 9G and the light emission control for the main scan in the timing shown in FIGS. 10A to 10G are alternately performed for each sub-scan.

Figures 9A, 9B, 9C, 9D, 9E, 9F, 9G:
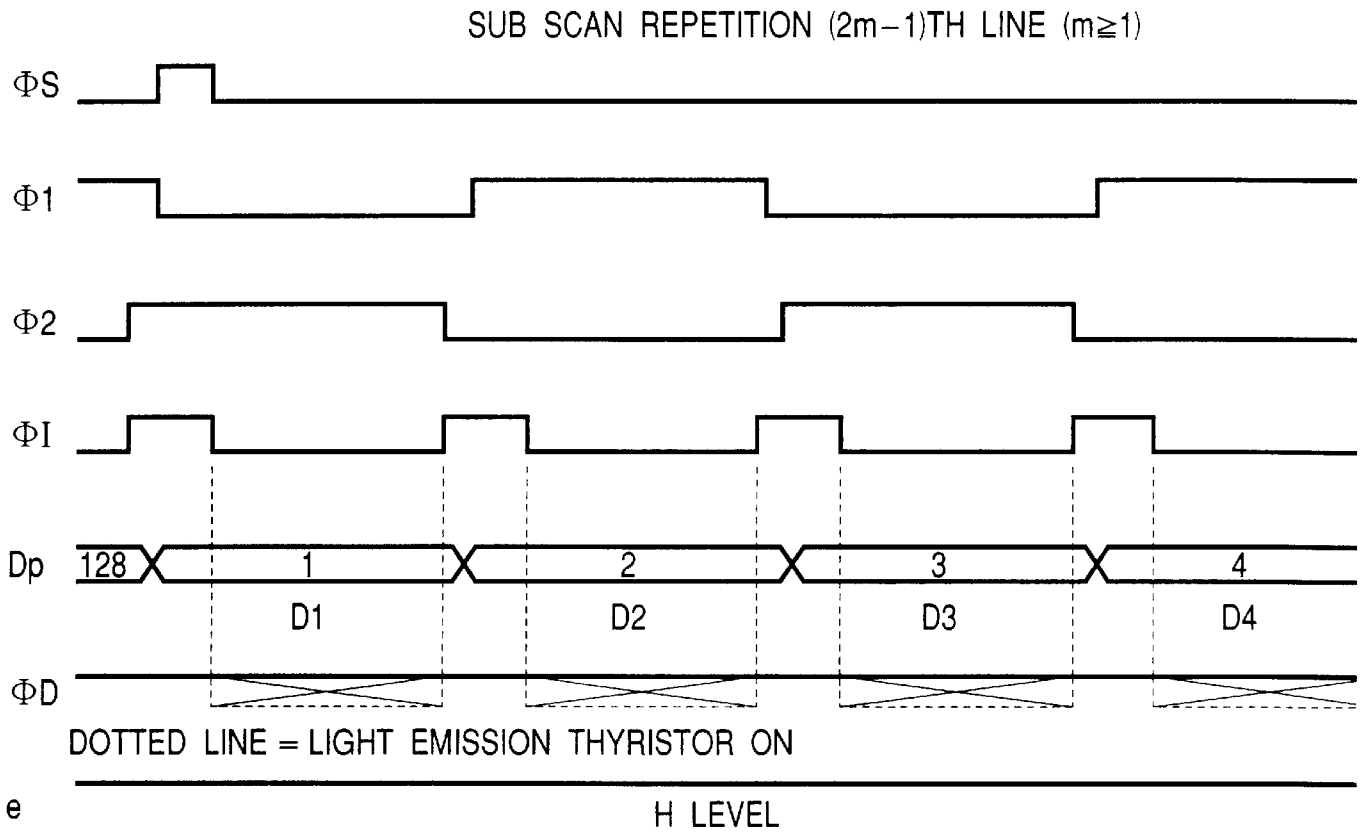
FIGS. 9A, 9B, 9C, 9D, 9E, 9F and 9G are timing charts showing LED array light emission control operations in the optical scan apparatus and the image formation apparatus according to one embodiment of the present invention.
Figures 10A, 10B, 10C, 10D, 10E, 10F, 10G:
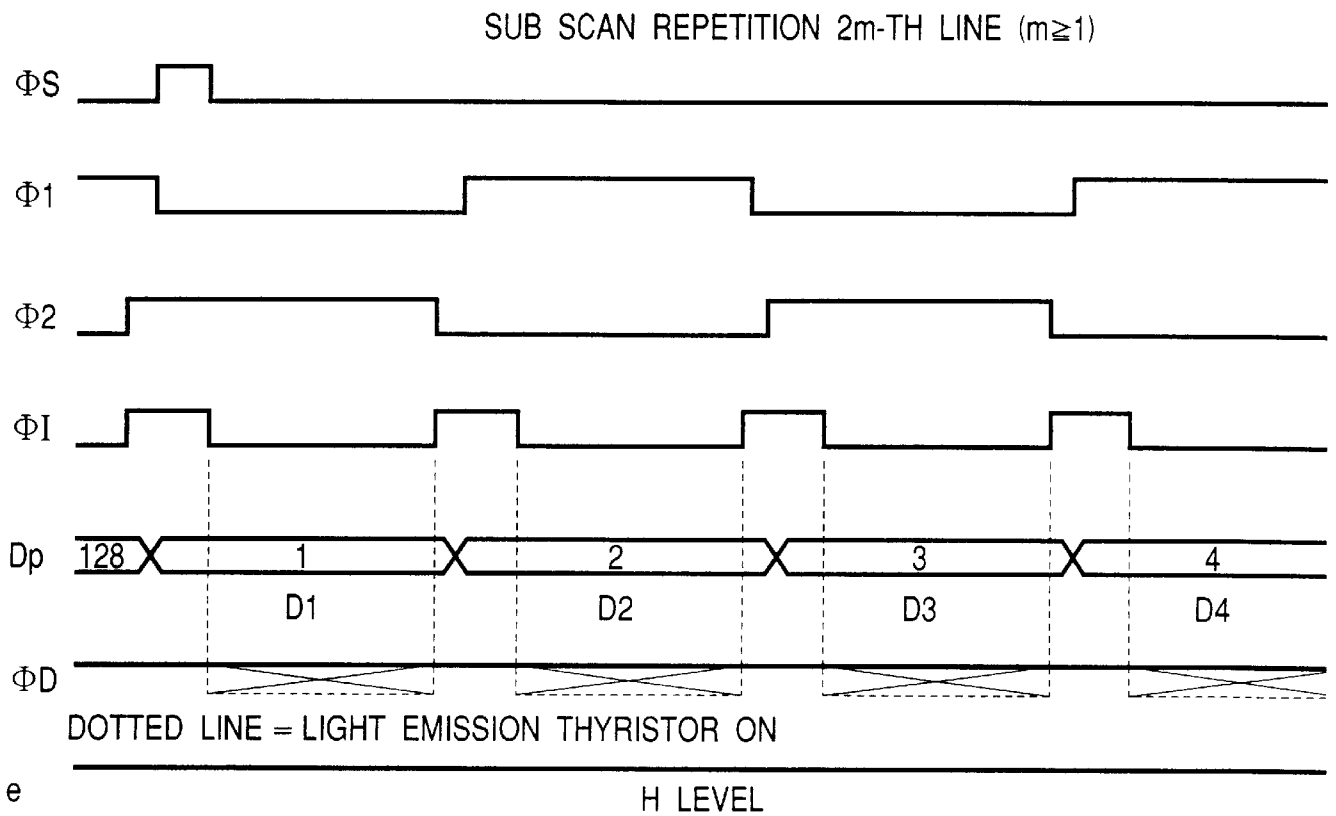
FIGS. 10A, 10B, 10C, 10D, 10E, 10F and 10G are timing charts showing LED array light emission control operations in the optical scan apparatus and the image formation apparatus according to one embodiment of the present invention.

As shown in FIGS. 9G and 10G, the lighting time control signal e does not change every time the main scan is performed, but outputs the constant value ("H" in this case). With respect to the H-level lighting time control signal e, the LED array driving signal controller 603 outputs the lighting enable signal ΦI (FIGS. 9D and 10D) which is the pulse signal common to all the chips. The duty of the signal ΦI does not change for each sub-scan line. Although the duty ratio of the signal ΦI is uniformly set to 70% in this case, the value of the duty ratio is not limited to this.

Further, at this time, the image data controller 600 transmits identical data (Φ=1 or 0) for each two scan lines to the LED array driving signal controller 603, on the basis of binary image data transmitted from a main control block of the image formation apparatus or externally (both not shown).

By such the light emission control as above, in the first example, it is possible to realize that the sub-scan image resolution is 600 dpi and the number of gradation is the binary value.

Subsequently, the case where the sub-scan image resolution is 600 dpi and the number of gradation is the four-level value will be explained as a second example. The timing charts of this second example are shown in FIGS. 11A to 11G and FIGS. 12A to 12G. FIGS. 11A to 11G show the timing charts for odd lines (i.e., (2m−1)th line), and FIGS. 12A to 12G show the timing charts for even lines (i.e., 2m-th line). The light emission control for the main scan in the timing shown in FIGS. 11A to 11G and the light emission control for the main scan in the timing shown in FIGS. 12A to 12G are alternately performed for each sub-scan.

Figures 11A, 11B, 11C, 11D, 11E, 11F, 11G:
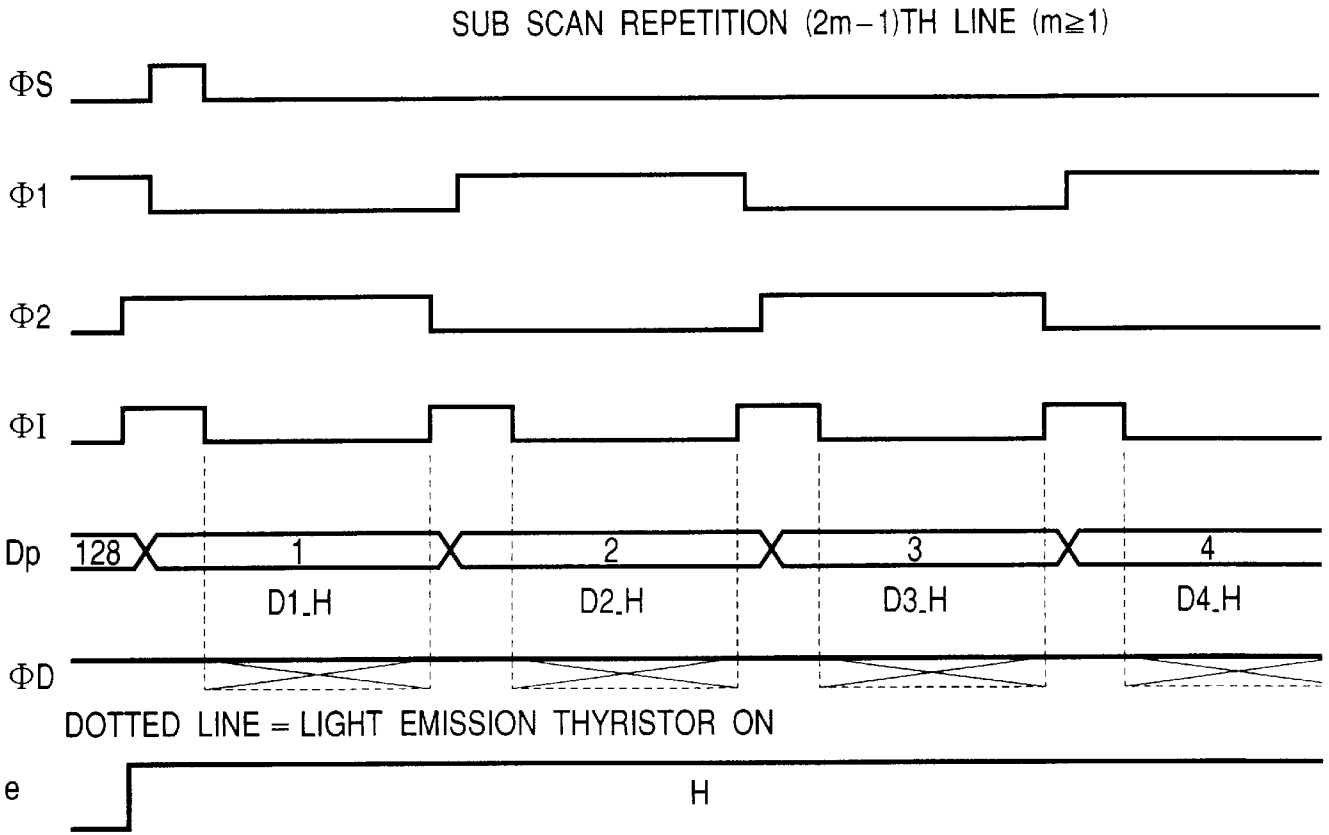
FIGS. 11A, 11B, 11C, 11D, 11E, 11F and 11G are timing charts showing LED array light emission control operations in the optical scan apparatus and the image formation apparatus according to one embodiment of the present invention.
Figures 12A, 12B, 12C, 12D, 12E, 12F, 12G:
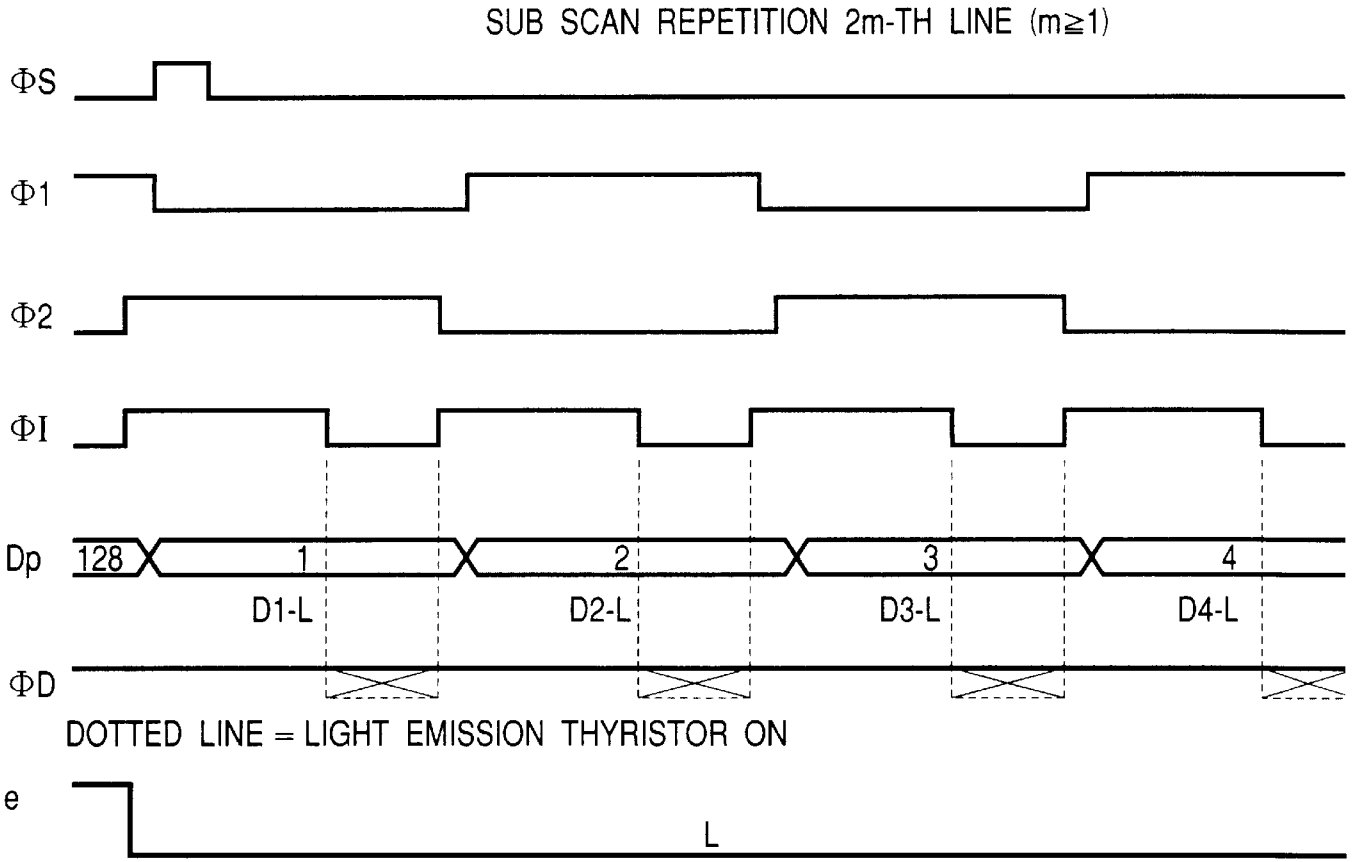
FIGS. 12A, 12B, 12C, 12D, 12E, 12F and 12G are timing charts showing LED array light emission control operations in the optical scan apparatus and the image formation apparatus according to one embodiment of the present invention.

As shown in FIGS. 11G and 12G, the lighting time control signal e alternately repeats "H" and "L". According to level changes of this lighting time control signal e, the duty of the lighting enable signal ΦI (FIGS. 11D and 12D) which is common to all the chips of the LED array head 516 changes into two kinds for each sub-scan. In the illustrated example, although the duty ratio is first 70% (for the odd line) and then 35% (for the even line), the values of the duty ratio are not limited to them.

Further, at this time, the image data controller 600 transmits a data signal to the LED array controller 603, on the basis of the four-value image data transmitted from a main control block of the image formation apparatus or externally (both not shown). In this case, the data signal is weighted for each scan line such that the weight of first time scan is 2 and the weight of next time scan is 1, as follows.

| | First-Time Scan | Next-Time Scan |
|---|---|---|
| Image Data 3 | ΦD = 1 | ΦD = 1 |
| Image Data 2 | ΦD = 1 | ΦD = 0 |
| Image Data 1 | ΦD = 0 | ΦD = 1 |
| Image Data 0 | ΦD = 0 | ΦD = 0 |

By such the light emission control as described above, it is possible to realize that the sub-scan image resolution is 600 dpi and the number of gradation is the four-level value for the two scan lines.

Finally, the case where the sub-scan image resolution is 1200 dpi and the number of gradation is the binary value will be explained as a third example. The timing charts of this third example are shown in FIGS. 13A to 13G and FIGS. 14A to 14G. FIGS. 13A to 13G show the timing charts for odd lines (i.e., (2m−1)th line), and FIGS. 14A to 14G show the timing charts for even lines (i.e., 2m-th line). The light emission control for the main scan in the timing shown in FIGS. 13A to 13G and the light emission control for the main scan in the timing shown in FIGS. 14A to 14G are alternately performed for each main scan.

Figures 13A, 13B, 13C, 13D, 13E, 13F, 13G:
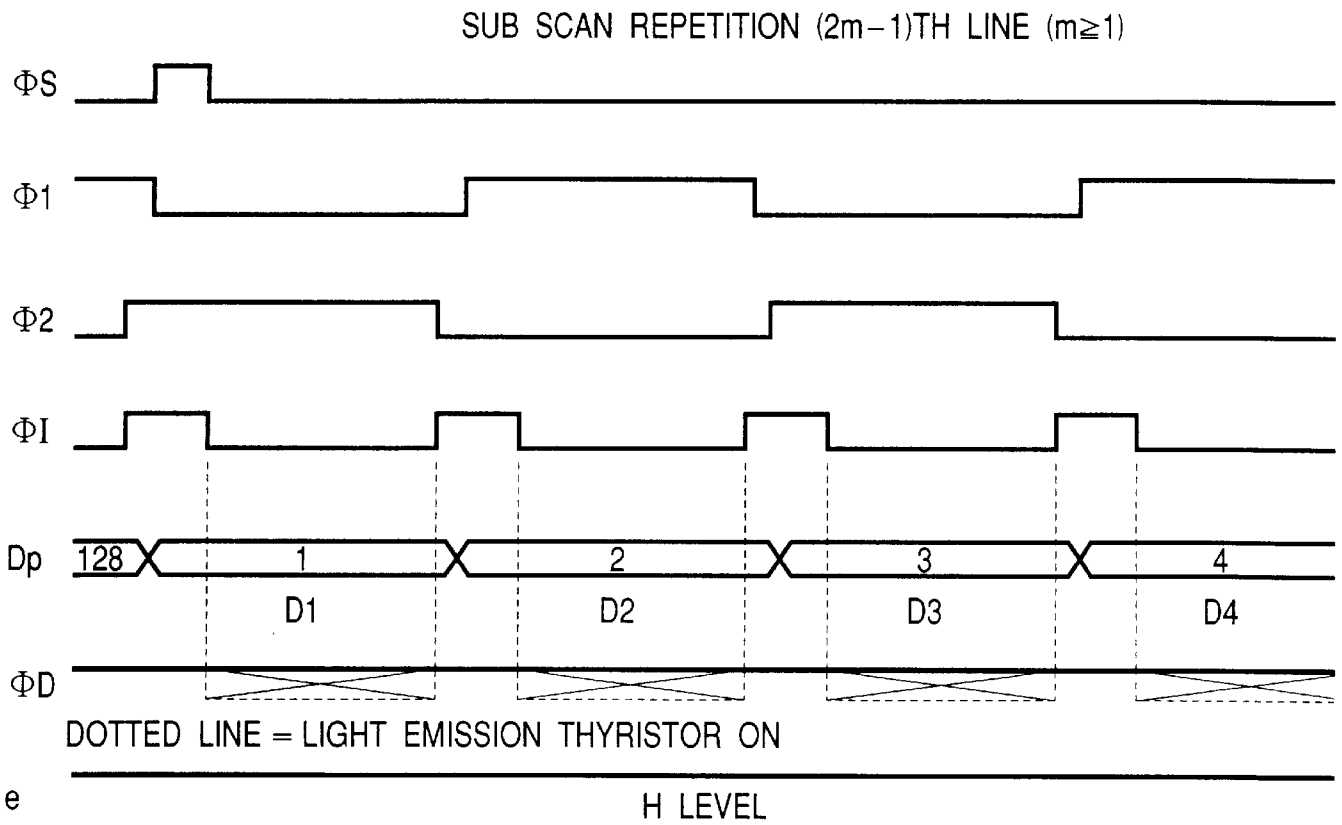
FIGS. 13A, 13B, 13C, 13D, 13E, 13F and 13G are timing charts showing LED array light emission control operations in the optical scan apparatus and the image formation apparatus according to one embodiment of the present invention.
Figures 14A, 14B, 14C, 14D, 14E, 14F, 14G:
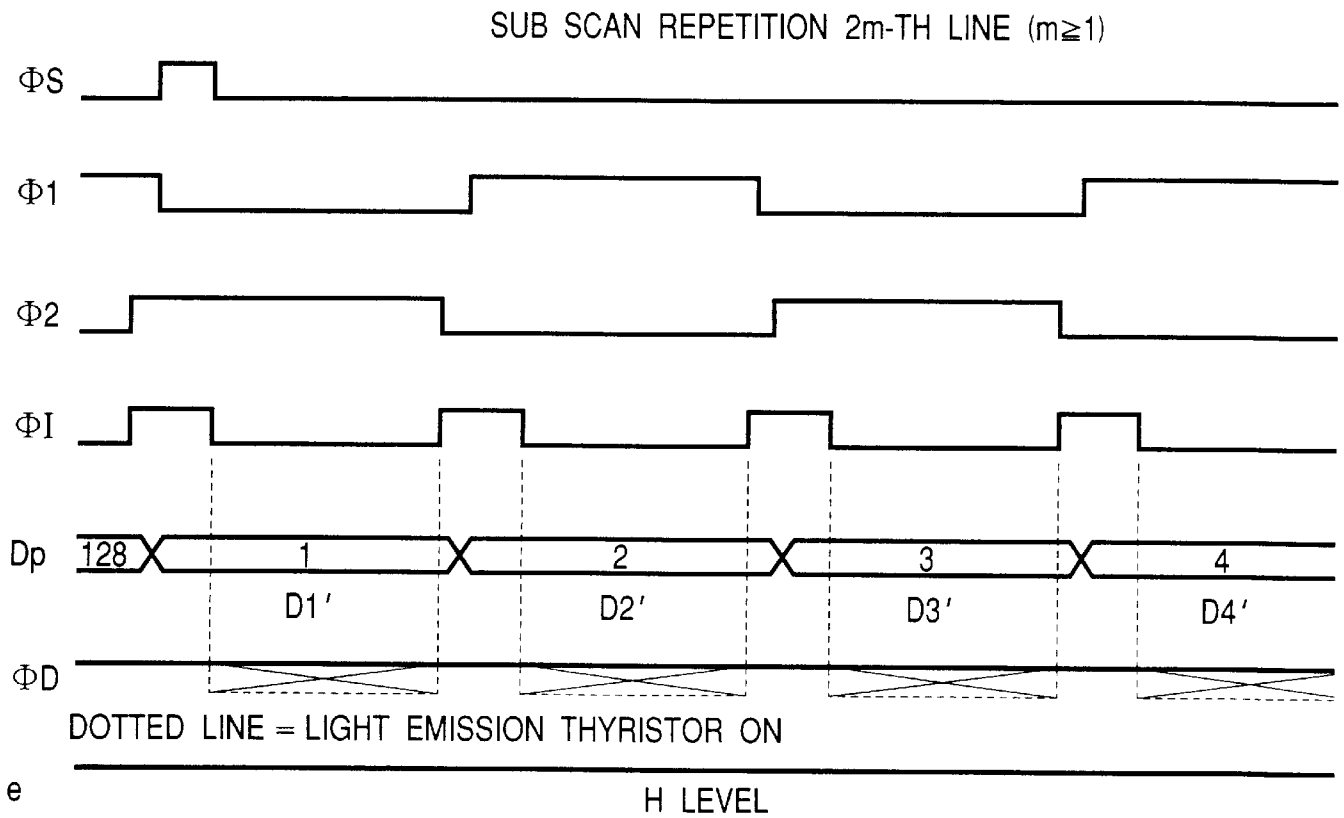
FIGS. 14A, 14B, 14C, 14D, 14E, 14F and 14G are timing charts showing LED array light emission control operations in the optical scan apparatus and the image formation apparatus according to one embodiment of the present invention.

As shown in FIGS. 13G and 14G, the lighting time control signal e does not change every time the main scan is performed, but outputs the constant value ("H" in this case). With respect to the H-level lighting time control signal e, the LED array driving signal controller 603 outputs the lighting enable signal ΦI (FIGS. 13D and 14D) which is the pulse signal common to all the chips. The duty of the signal ΦI does not change for each main scan line. Although the duty ratio of the signal ΦI is uniformly set to 70% in this case, the value of the duty ratio is not limited to this.

Further, at this time, the image data controller 600 transmits data (ΦD=1 or 0) for each main scan to the LED array driving signal controller 603, on the basis of resolution 1200 dpi and the binary image data transmitted from a main control block of the image formation apparatus or externally (both not shown).

By such the light emission control as above, it is possible to realize that the sub-scan image resolution is 1200 dpi and the number of gradation is the binary value.

As explained above, in the present embodiment, the main scan speed of the recording line on the photosensitive drum is set to the value corresponding to twice the main scan resolution, and all the LED chips are driven in common by using the light emission enable signal. Further, the duty ratio is changed every time the sub-scan is repeated to change the ON time to the predetermined value, whereby the number of gradations of the input image is changed from the binary value to the four-level value. Therefore, as above, it is possible to reduce the quantity of the sawtoothed difference of the recording line in the sub-scan direction. Further, without directly modulating a light emission current or light emission duty for individual light emission element, it is possible, using only one light emission current modulation means or one light emission duty modulation means, to select and change the image resolution and the number of gradations in the sub-scan direction, from the plural combinations (e.g., the first to third examples in the present embodiment).

According to the above-explained embodiment, there are provided the means which repeatedly forms the optical writing line on the photosensitive body rotatively driven around the rotational axis (i.e., the rotational center) substantially parallel with the main scan direction by performing the main scan to cause the plural light emission elements to emit light according to the image data, the scan means which performs the optical scan such that the optical writing line formed on the rotating photosensitive body is relatively moved at the predetermined speed in the sub-scan direction substantially perpendicular to the main scan direction, the light emission control means which repeatedly forms the optical writing line at the speed corresponding to n times the light emission element disposing pitch and generates the light emission signal to be used for controlling the light emission of the plural light emission means in common, and the selection means which selects the number of gradations of the image formed by the optical writing line within the range from the binary value to the $2^n$-level value by changing the timing of the light emission signal according to the desired sub-scan resolution and the number of gradations of the input predetermined-gradation image data. Thus, it is possible to reduce the quantity of the sawtoothed difference of the recording line in the sub-scan direction. Further, without directly modulating the light emission current or the light emission duty for the individual light emission element, it is possible only by one light emission current modulation means or one light emission duty modulation means to select and change the image resolution and the number of gradations in the sub-scan direction, from the plural combinations.

In the above-described embodiment, the recording element array chip which includes the self-scanning function has been explained by way of example. However, the array chip may externally uses the self-scanning function.

Further, in the above-described embodiment, the light emission thyristor has been explained as the example of the recording element. However, other recording elements such as a heating element and the like may be used.

The present invention is applicable to a system composed of plural equipments (e.g., a host computer, an interface equipment, a reader, a printer and the like) or to an apparatus including a single equipment (e.g., a copying machine, a facsimile machine or the like).

It is needless to say that the object of the present invention can be achieved in a case where a storage medium storing the program codes of a software for realizing the functions of the above-described embodiments is supplied to a system or an apparatus and then a computer (or CPU or MPU) in the system or the apparatus reads and executes the program codes stored in the memory medium.

In this case, the program codes themselves read from the storage medium realize the functions of the embodiments, and the storage medium storing such the program codes constitute the present invention.

The storage medium storing the program codes can be, for example, a floppy disk, a hard disk, an optical disk, a magnetooptical disk, a CD-ROM, a CD-R, a magnetic tape, a non-volatile memory card, a ROM, or the like.

It is needless to say that the present invention also includes not only the case where the functions of the embodiments are realized by the execution of the program codes read by the computer, but also a case where an OS (operating system) or the like functioning on the computer executes all the process or a part thereof according to the instructions of the program codes, thereby realizing the functions of the embodiments.

Further, it is needless to say that the present invention further includes a case where the program codes read from the storage medium are once stored in a memory provided in a function expansion board inserted in the computer or a function expansion unit connected to the computer, and a CPU or the like provided in the function expansion board or the function expansion unit executes all the process or a part thereof according to the instructions of such program codes, thereby realizing the functions of the embodiments.

Although the present invention has been explained by using the several preferred embodiments, the invention is not limited to the structures of these embodiments. That is, various modifications and changes are possible in the invention without departing from the spirit and scope of the annexed claims.

What is claimed is:

1. An image formation apparatus which records an image on a recording medium, comprising:

a recording element array head on which plural recording chips are disposed, plural recording elements being arrayed in each recording chip and being arranged with a pitch Pv;

main scan means for scanning said respective recording elements of each recording chip simultaneously; and sub-scan means for moving at least one of the recording medium and said recording chips relative to one another toward a sub-scan direction, wherein said main scan means scans said recording elements n times on the basis of the same image data corresponding to one scan, wherein $n \geqq 2$, and a disposing direction of said recording chips is deviated from a direction perpendicular to the sub-scan direction, by a predetermined angle, so that a recording element on an end of one of said recording chips is shifted by a distance Pv/n with respect to a recording element on an end of an adjacent one of said recording chips along the sub-scan direction.

2. An apparatus according to claim 1, wherein the predetermined angle is determined in accordance with the movement distance by said sub-scan means during one scan period.

3. An apparatus according to claim 1, wherein the speed of the main scan is changed according to movement speed by said sub-scan means toward the sub-scan direction.

4. An apparatus according to claim 1, wherein said recording element is a light emission element.

5. An apparatus according to claim 4, wherein said light emission element is a light emission thyristor.

6. An apparatus according to claim 1, wherein said recording chip includes a transfer element for scanning said recording element.

7. A recording element array head which is used for an image formation apparatus for recording an image on a recording medium, comprising:

a base substrate; and plural recording chips disposed on the base substrate along a main scan direction, wherein plural recording elements are arrayed in each chip and are arranged with a pitch Pv, wherein a disposing direction of said recording chips is deviated from a direction perpendicular to a sub-scan direction by a predetermined angle, so that a recording element on an end of one of said recording chips is shifted by a distance Pv/n with respect to a recording element on an end of an adjacent one of said recording chips along the sub-scan direction, wherein $n \geqq 2$, wherein n is the number of times of scanning the same image data corresponding to one scan, and wherein said recording elements are scanned n times on the basis of the same image data corresponding to one scan.

8. A recording element array head according to claim 7, wherein said respective recording elements of each chip are scanned simultaneously.

9. A recording element array head according to claim 7, wherein at least one of the recording medium and said recording chips is moved relative to one another toward the sub-scan direction.

10. A recording element array head according to claim 7, wherein said recording element is a light emission element.

11. A recording element array head according to claim 7, wherein said recording chip includes scan means for scanning said recording elements.

12. An image formation apparatus which records an image on a recording medium, comprising:

a recording element array head on which plural recording chips are disposed, plural recording elements being arrayed in each chip and being arranged with a pitch Pv;

main scan means for scanning said respective recording elements of each recording chip simultaneously; and sub-scan means for moving at least one of the recording medium and said recording chips relative to one another toward a sub-scan direction, wherein writing resolution in the sub-scan direction is n times as much as resolution of the recording elements in the main scan direction and is a natural number, and a disposing direction of said recording chips is deviated from a direction perpendicular to the sub-scan direction, by a predetermined angle, so that a recording element on an end of one of said recording chips is shifted by a distance Pv/n with respect to a recording element on an end of an adjacent one of said recording chips along the sub-scan direction.

13. An apparatus according to claim 12, wherein the predetermined angle is determined in accordance with the movement distance by said sub-scan means during one scan period.

14. An apparatus according to claim 12, wherein the speed of the main scan is changed according to movement speed by said sub-scan means toward the sub-scan direction.

15. An apparatus according to claim 12, wherein said recording element is a light emission element.

16. An apparatus according to claim 15, wherein said light emission element is a light emission thyristor.

17. An apparatus according to claim 12, wherein said recording chip includes a transfer element for scanning said recording element.

* * * * *